US005158063A

United States Patent [19]

Hosoda et al.

[11] Patent Number: 5,158,063

[45] Date of Patent: Oct. 27, 1992

[54] AIR-FUEL RATIO CONTROL METHOD FOR INTERNAL COMBUSTION ENGINES

[75] Inventors: Fumio Hosoda; Sachito Fujimoto; Hiroshi Ito; Shunji Takahashi, all of Wako, Japan

[73] Assignee: Honda Giken Kogyo K.K., Tokyo, Japan

[21] Appl. No.: 812,705

[22] Filed: Dec. 23, 1991

[30] Foreign Application Priority Data

Dec. 28, 1990 [JP] Japan ..... 2-417324

[51] Int. Cl.[5] ..... F02M 51/00

[52] U.S. Cl. ..... 123/676; 123/672; 123/687; 60/277

[58] Field of Search ..... 123/489, 440; 364/431.09, 431.05, 431.06; 60/277, 274

[56] References Cited

U.S. PATENT DOCUMENTS

| | | | |
|---|---|---|---|
| 4,026,106 | 5/1977 | Tamazawa et al. | 60/277 |
| 4,058,978 | 11/1977 | Bockelmann et al. | 60/277 |
| 4,192,140 | 3/1980 | Yamashita et al. | 60/277 |
| 4,233,811 | 11/1980 | Masaki | 60/277 |
| 4,484,548 | 11/1984 | Sugusawa et al. | 60/277 |
| 4,729,220 | 3/1988 | Torasaka et al. | 60/277 |
| 4,889,099 | 12/1989 | Tonishawa | 123/440 |
| 4,913,118 | 4/1990 | Watanabe | 123/489 |
| 4,928,654 | 5/1990 | Hosaka | 123/486 |
| 5,016,595 | 5/1991 | Kawai et al. | 123/440 |

*Primary Examiner*—Raymond A. Nelli
*Attorney, Agent, or Firm*—Arthur L. Lessler

[57] ABSTRACT

An air-fuel ratio control method for an internal combustion engine. The air-fuel ratio of an air-fuel mixture supplied to the engine is feedback-controlled to a predetermined value in response to an output from the exhaust gas ingredient concentration sensor. The temperature of at least one component part of the engine, which should be controlled, is estimated based on the detected temperature of exhaust gases, engine rotational speed, and engine load. The air-fuel ratio of the air-fuel mixture is inhibited from being feedback-controlled but enriched, when the estimated temperature of any one of the at least one component part of the engine is higher than a corresponding predetermined value.

8 Claims, 17 Drawing Sheets

AIR-FUEL RATIO CONTROL METHOD FOR INTERNAL COMBUSTION ENGINES

BACKGROUND OF THE INVENTION

1. Field of the Invention

This invention relates to an air-fuel ratio control method for internal combustion engines, and more particularly to a method of controlling the air-fuel ratio of an air-fuel mixture supplied to an internal combustion engine when the engine is in a high load operating condition.

2. Prior Art

It is conventionally known to control the air-fuel ratio of an air-fuel mixture supplied to an internal combustion engine (hereinafter referred to as "the supply air-fuel ratio") to a stoichiometric air-fuel ratio or its vicinity when load on the engine is relatively low, and enrich the supply air-fuel ratio to prevent the temperature of the engine from rising to an excessive degree by utilizing the effects of cooling by fuel in the air-fuel mixture supplied to the engine, when the load on the engine is high. To carry out this air-fuel ratio control method, the following techniques have conventionally been proposed:

(1) A desired exhaust gas temperature is set based on the amount of intake air, engine rotational speed, and engine coolant temperature, and the supply air-fuel ratio is controlled such that the actual exhaust gas temperature becomes equal to the set desired exhaust gas temperature (Japanese Provisional Patent Publication (Kokai) No. 60-90940).

(2) An exhaust gas temperature is estimated based on the amount of intake air or engine rotational speed and the supply air-fuel ratio is enriched to a greater extent as the estimated exhaust gas temperature is higher (Japanese Patent Publication (Kokoku) No. 62-54977).

(3) The temperature of a catalytic converter provided in an internal combustion engine is estimated based on the amount of intake air and the supply air-fuel ratio, whereby the supply air-fuel ratio is controlled so as to prevent an excessive rise in the temperature of the catalytic converter (Japanese Provisional Patent Publication (Kokai) No. 62-203965).

(4) An engine temperature is estimated based on engine rotational speed, load on the engine, and the supply air-fuel ratio, and enriching of the supply air-fuel ratio is controlled depending on the estimated engine temperature (Japanese Provisional Patent Publication (Kokai) No. 3-18643).

Further, to determine whether an oxygen concentration sensor arranged in an exhaust passage of the engine is activated or not, the following technique has also been proposed:

(5) The temperature of the oxygen concentration sensor is estimated based on the amount of intake air and outside air temperature (Japanese Provisional Patent Publication (Kokai) No. 1-219340).

According to the above techniques (2) to (5). the exhaust gas temperature or the temperature of an engine component part is estimated based on engine operating parameters, such as the amount of intake air and engine rotational speed, but the actual exhaust gas temperature is not detected. Therefore, there is a possibility of an estimated value of the exhaust gas temperature becoming largely different from an actual value of same. To overcome this disadvantage, it is required to make wider the engine operating region in which the supply air-fuel ratio should be enriched (hereinafter referred to as "the high load enriching region"), i.e. set a reference temperature for determining whether the supply air-fuel ratio should be enriched to a lower value. As a result, there can be cases where the air-fuel ratio is unnecessarily enriched, which results in degradation of fuel consumption and exhaust emission characteristics.

Further, according to the above technique (1), the temperature of the exhaust system is determined only by detecting the exhaust gas temperature, and the desired exhaust gas temperature is set based on the amount of intake air, engine rotational speed, intake air temperature, and engine coolant temperature to control the supply air-fuel ratio such that the detected exhaust gas temperature becomes equal to the desired exhaust gas temperature. However, the temperature of engine component parts, which may rise to an excessive degree, varies not only by the exhaust gas temperature but also by the volume of hot exhaust gases. More specifically, even if the exhaust gas temperature remains unchanged, the rate of rise in the temperature of engine component parts tends to be lower when the volume of exhaust gases (which may be determined by the engine rotational speed and engine load) is smaller than when the volume of exhaust gases is larger. In the case of a three-way catalyst, for example, it has been found that even if the exhaust gas temperature remains unchanged, when the engine is in a high load and high engine rotational speed condition, in which the volume of exhaust gases is larger, the rate.of thermal conduction to the three-way catalyst tends to increase due to the flow of an increased volume of hot exhaust gases to cause the temperature of the three-way catalyst to rise at a higher rate. On the other hand, when the volume of exhaust gases is smaller, the temperature of the three-way catalyst rises at a lower rate in spite of the presence of the flow of hot exhaust gases. Further, it has also been found that due to difference in thermal capacity between engine component parts, the amount of thermal conduction therethrough varies with the engine component parts, which causes the temperatures of the engine component parts to rise at different rates as time elapses. Therefore, there is room for improvement of this technique (1) concerning fuel consumption and exhaust emission characteristics.

SUMMARY OF THE INVENTION

It is an object of the invention to provide an air-fuel ratio control method for an internal combustion engine which is capable of improving the accuracy of estimated temperatures of component parts of the engine, and reducing fuel consumption and emission of CO when the engine is in a high load operating condition.

To attain the above object, the invention provides an air-fuel ratio control method for an internal combustion engine including an exhaust passage, an exhaust gas ingredient concentration sensor arranged in the exhaust passage for detecting concentration of an exhaust gas ingredient, and at least one component part temperature of which is to be controlled, wherein the air-fuel ratio of an air-fuel mixture supplied to the engine is feedback-controlled to a predetermined value in response to an output from the exhaust gas ingredient concentration sensor, and when it is determined that the engine is in a predetermined high load operating condition and at the same time the at least one component part of the engine is in a predetermined high temperature state, the air-fuel ratio of the air-fuel mixture is inhibited from being feedback-controlled but enriched instead.

The air-fuel ratio control method according to the invention is characterized by comprising the steps of:

(1) detecting a temperature of exhaust gases emitted from the engine;

(2) detecting rotational speed of the engine;

(3) detecting load on the engine;

(4) estimating temperature of the at least one component part of the engine based on the temperature of exhaust gases, engine rotational speed, and engine load, detected at the above steps (1) to (3); and (5) determining that the at least one component part of the engine is in the predetermined high temperature state when the estimated temperature of any one of the at least one component part of the engine is higher than a corresponding predetermined value.

Preferably, the estimated temperature T of the at least one component part of the engine is calculated by the use of the following equation:

$$T = TE \times KNE \times KPB$$

where TE represents the detected temperature of exhaust gases, KNE represents an engine rotational speed-dependent correction coefficient set according to the detected engine rotational speed, and KPB represents an engine load-dependent correction coefficient set according to the detected engine load.

More preferably, the engine rotational speed-dependent correction coefficient KNE is set to a larger value as the engine rotational speed is higher, and the engine load-dependent correction coefficient KPB is set to a larger value as the engine load is higher.

Preferably, the estimated temperature of the at least one component part of the engine is obtained by averaging a plurality of values of the estimated temperature, and the speed of the averaging is changed depending on the engine load.

More preferably, the engine load is intake pipe absolute pressure corrected according to intake air temperature.

Preferably, the air-fuel ratio of an air-fuel mixture supplied to the engine is controlled to a first value richer than a stoichiometric air-fuel ratio after it was determined that the at least one component part of the engine is in the predetermined high temperature state and before a predetermined time period elapses thereafter, and the air-fuel ratio of the air-fuel mixture is controlled to a second value richer than the first value after the predetermined time period elapses.

More preferably, the enriching of the air-fuel ratio of the air-fuel mixture is carried out by multiplying a basic amount of fuel supplied to the engine, which is determined according to the engine rotational speed detected and intake pipe pressure, by a predetermined enriching coefficient, the predetermined enriching coefficient being determined based on the engine rotational speed detected and the intake pipe pressure.

Further preferably, the predetermined enriching coefficient is set to a value read from a map set according to the engine rotational speed detected and the intake pipe pressure before the predetermined time period elapses to thereby control the air-fuel ratio of the air-fuel mixture to the first value, the predetermined enriching coefficient being set to a value obtained by multiplying the value read from the map by an enriching coefficient after the predetermined time period has elapsed to thereby control the air-fuel ratio of the air-fuel mixture to the second value.

The above and other objects, features, and advantages of the invention will be more apparent from the ensuing detailed description taken in conjunction with the accompanying drawings.

DETAILED DESCRIPTION

The method according to the invention will now be described in detail with reference to the drawings showing an embodiment thereof.

Figure 1:
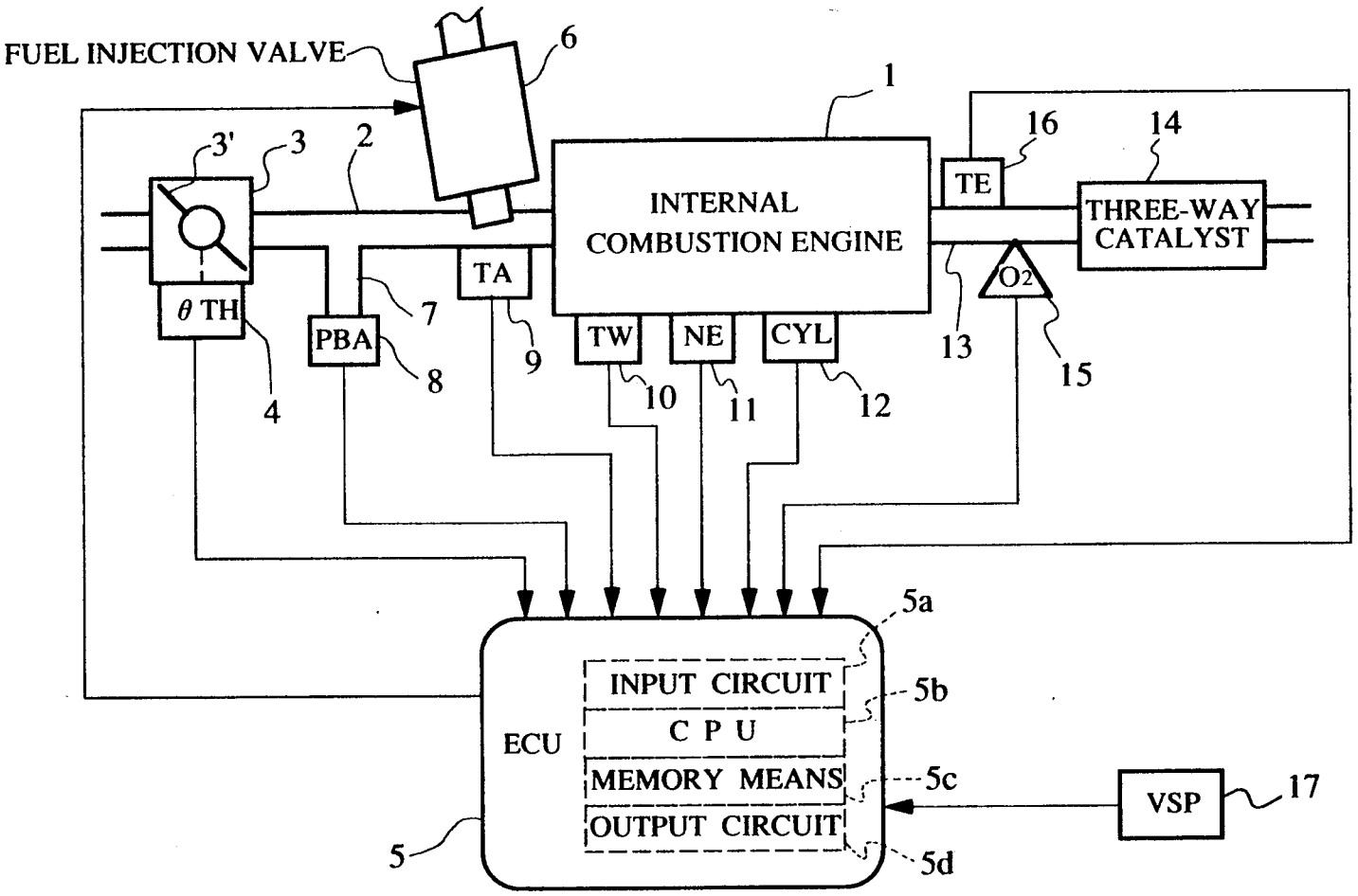
FIG. 1 is a schematic diagram of the whole arrangement of a fuel supply control system for an internal combustion engine to which is applied the control method according to the invention.

Referring first to FIG. 1, there is shown the whole arrangement of a fuel supply control system which is adapted to carry out the control method of this invention. In the figure, reference numeral 1 designates an internal combustion engine. In an intake pipe 2 of the engine 1, there is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying same to an electronic control unit (hereinafter referred to as "the ECU") 5.

Fuel injection valves 6 ar each provided for each cylinder, not shown, and arranged in the intake pipe 2 between the engine 1 and the throttle valve 3, and at a location slightly upstream of an intake valve, not shown. The fuel injection valves 6 are connected to a fuel pump, not shown, and electrically connected to the ECU 5 to have their valve opening periods controlled by signals therefrom.

Further, an intake pipe absolute pressure (PBA) sensor 8 is provided in communication with the interior of the intake pipe 2 via a conduit 7 at a location immediately downstream of the throttle valve 3' for supplying an electric signal indicative of the sensed absolute pressure to the ECU 5. An intake temperature (TA) sensor 9 is inserted into the intake pipe 2 at a location downstream of the intake pipe absolute pressure sensor 8 for supplying an electric signal indicative of the sensed intake temperature TA to the ECU 5.

An engine coolant temperature (TW) sensor 10, which may be formed of a thermistor or the like, is mounted in the cylinder block of the engine 1 for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and $NO_X$. An $O_2$ sensor 15 as an exhaust gas ingredient concentration sensor is mounted in the exhaust pipe 13 at a location upstream of the three-way catalyst 14, for detecting the oxygen concentration in the exhaust gases and supplying an electric signal indicative of a detected value of the oxygen concentration to the ECU 5. Further, an exhaust gas temperature sensor 16 is mounted in the exhaust pipe 13 at a location upstream of the $O_2$ sensor 15 for supplying a signal indicative of a detected value of the exhaust gas temperature to the ECU 5. A vehicle speed (VSP) sensor 17, which is also connected to the ECU 5, detects a travelling speed (vehicle speed VSP) of an automotive vehicle on which the engine is installed, and supplies a signal indicative of the vehicle speed VSP to the ECU 5.

The ECU 5 comprises an input circuit 5*a* having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed in the CPU 5*b* and for storing results of calculations therefrom, etc., and an output circuit 5*d* which outputs driving signals to the fuel injection valves 6.

The CPU 5*b* operates in response to the above-mentioned signals from the sensors to determine operating conditions in which the engine 1 is operating such as an air-fuel ratio feedback control region and open-loop control regions, and calculates, based upon the determined operating conditions, the valve opening period or fuel injection period $T_{OUT}$ over which the fuel injection valves 6 are to be opened by the use of the following equation (1) in synchronism with inputting of TDC signal pulses to the ECU 5:

$$T_{OUT} = Ti \times K_1 \times KWOT \times KTW \times K_{O2} + K_2 \quad (1)$$

where Ti represents a basic fuel amount, more specifically a basic fuel injection period, and is read from a Ti map set according to the engine rotational speed NE and the intake pipe absolute pressure PBA and stored in the memory means 5*c*. KWOT is a high load enriching coefficient for enriching an air-fuel mixture supplied to the engine when the throttle valve 3' is substantially fully open, and determined in such a manner as described hereinbelow with reference to FIGS. 14*a* and 14*b*. KTW is an engine coolant temperature-dependent fuel increasing coefficient for enriching the air-fuel mixture when the engine coolant temperature TW is equal to or lower than a predetermined value. $K_{O2}$ is an air-fuel ratio feedback correction coefficient which is set responsive to the oxygen concentration in the exhaust gases when the engine is in a feedback control region, and set, when the engine is not in the feedback control region but in any of particular regions (open loop control regions), to a value peculiar thereto. A state in which the engine is in a predetermined high load operating condition and the temperature of any of predetermined component parts of the engine is high is included in the open loop control regions.

$K_1$ and $K_2$ are other correction coefficients and correction variables, respectively, which are calculated based on various engine parameter signals to such values as to optimize characteristics of the engine such as fuel consumption and accelerability depending on engine operating conditions.

The CPU 5b supplies the fuel injection valves 6 with driving signals based on the fuel injection period $T_{OUT}$ calculated as above via the output circuit 5d.

Figure 2A:
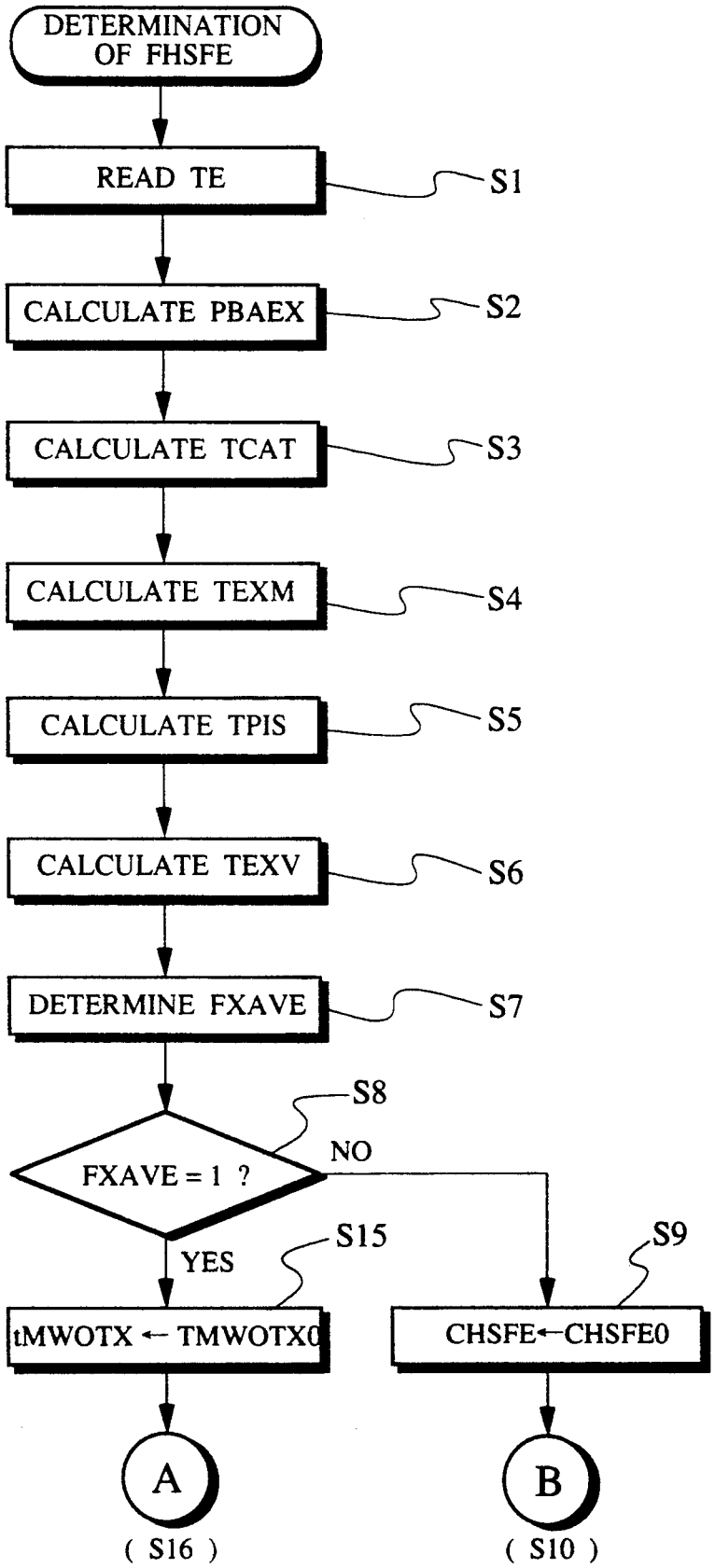
FIGS. 2*a* and 2*b* are flowcharts of a program for performing calculation of estimated temperatures of component parts of the engine.
Figure 2B:
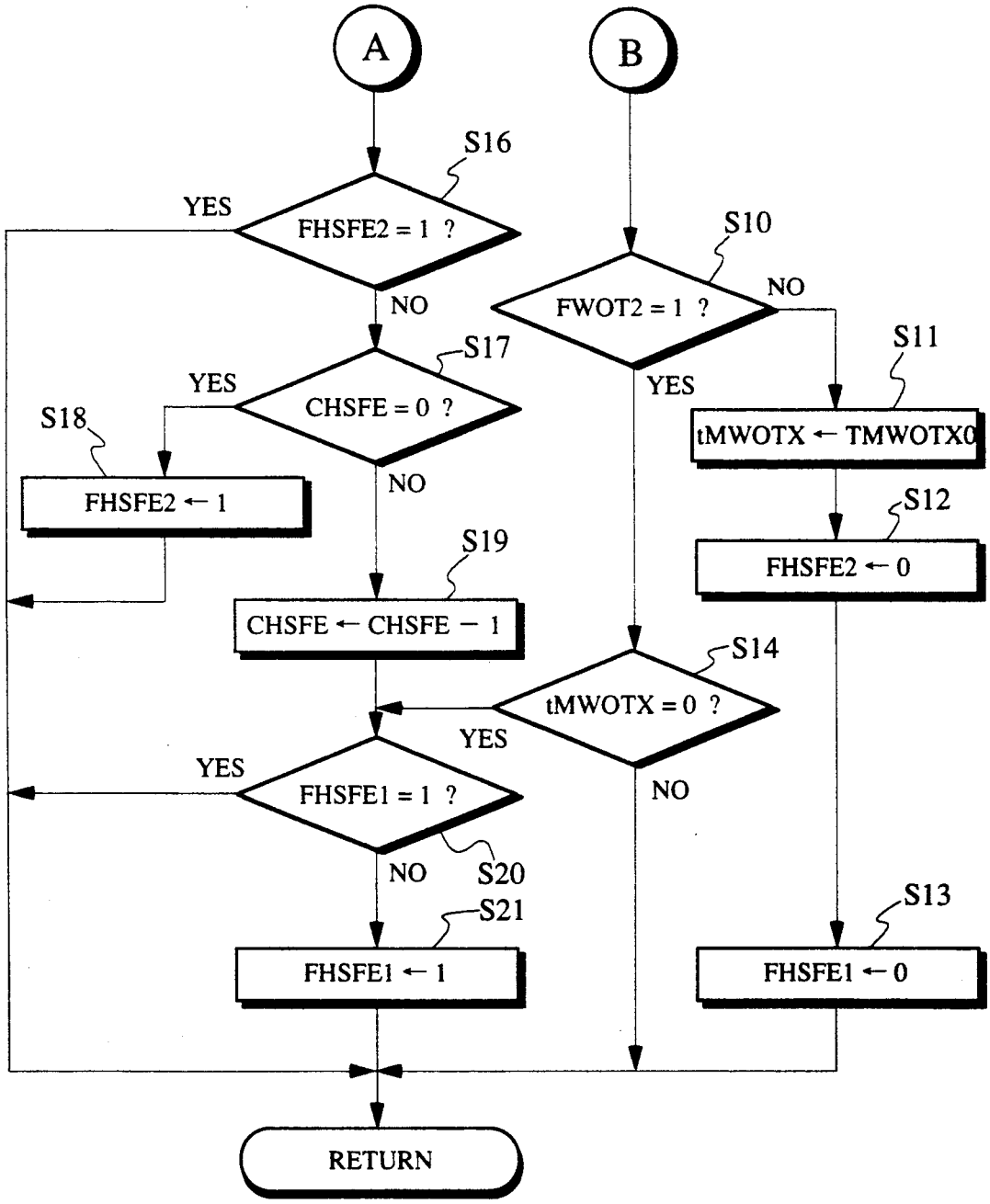

FIG 2 shows a program for calculating estimated temperature values of component parts of the engine, i.e. the three-way catalyst 14, the exhaust pipe 13, pistons in the cylinders, and the exhaust valves, and setting, based on the estimated temperature values, first and second enriching flags FHSFE1, FHSFE2 for enriching the supply air-fuel ratio. This program is executed at constant time intervals (e.g. of 80 millisec.).

At a step S1, an output from the exhaust gas temperature sensor 16 is read. The exhaust gas temperature sensor 16 used in the present embodiment is comprised of a thermistor. The output from the exhaust gas temperature sensor 16 is in a non-linear relationship to the exhaust gas temperature. Therefore, the sensor output is converted into the exhaust gas temperature (TE) by the use of a table stored in the memory means 5c. In performing the conversion, linear interpolation is effected for values of the sensor output other than the values of same stored beforehand.

Figure 3:
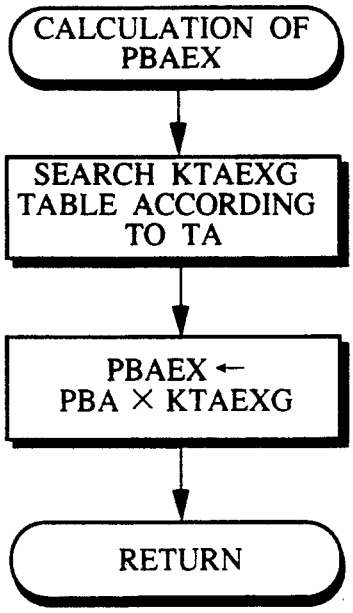
FIG. 3 is a flowchart of a subroutine for correcting the intake pipe absolute pressure depending on intake air temperature.
Figure 4:
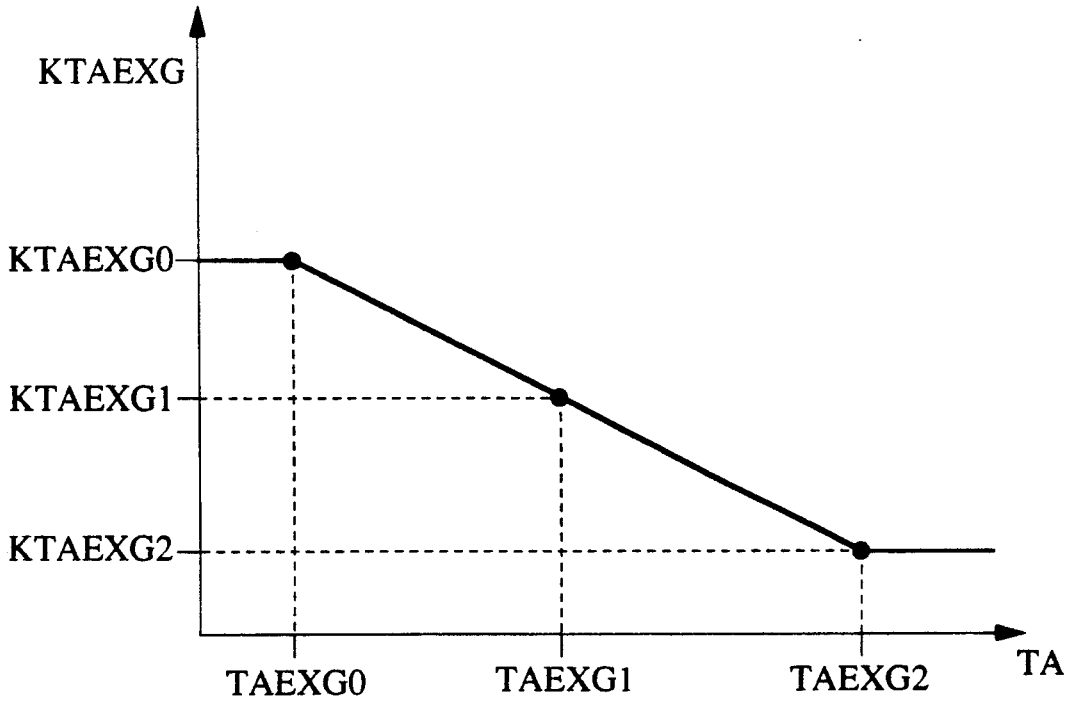
FIG. 4 is a diagram showing a table for calculating an intake air temperature-dependent correction coefficient (KTEXG)

At a step S2, the intake pipe absolute pressure PBA is corrected based on the intake air temperature TA, by a subroutine shown in FIG. 3. More specifically, an intake air temperature-dependent correction coefficient KTAEXG is calculated according to the intake air temperature TA, and the intake pipe absolute pressure PBA is multiplied by the coefficient KTAEXG to obtain corrected intake pipe absolute pressure PBAEX. The correction coefficient KTAEXG is read from a KTAEXG table in FIG. 4, in which coefficient values KTAEXG0 to KTAEXG2 (e.g. 1.15, 1.0, 0.95) are set corresponding to predetermined values TAEXG0 to TAEXG2 (e.g. −10° C., 30° C., 50° C.) of the intake air temperature TA. For values other than the predetermined values TAEXG0 to TAEXG2 of the intake air temperature TA, interpolation is carried out. Reading of values from other tables, referred to hereinafter, is similarly carried out. The intake air temperature-dependent correction of the intake pipe absolute pressure PBA is performed in order to take into consideration variation in charging efficiency caused by the intake air temperature TA. More specifically, as the charging efficiency is lower, the weight of intake air which is used in burning of the air-fuel mixture decreases, so that combustion temperature tends to become lower accordingly. In view of this tendency, the intake pipe absolute pressure PBA is corrected such that its value decreases to such an extend as corresponds to an amount of decrease in the weight of the intake air, whereby the accuracy of calculation of estimated values of increased temperatures of component parts in the exhaust system of the engine is improved.

Referring again to FIG. 2, at a step S3, an estimated temperature value (hereinafter simply referred to as the "catalyst temperature") TCAT of the three-way catalyst 14 is calculated by a subroutine shown in FIG. 5.

Figure 5:
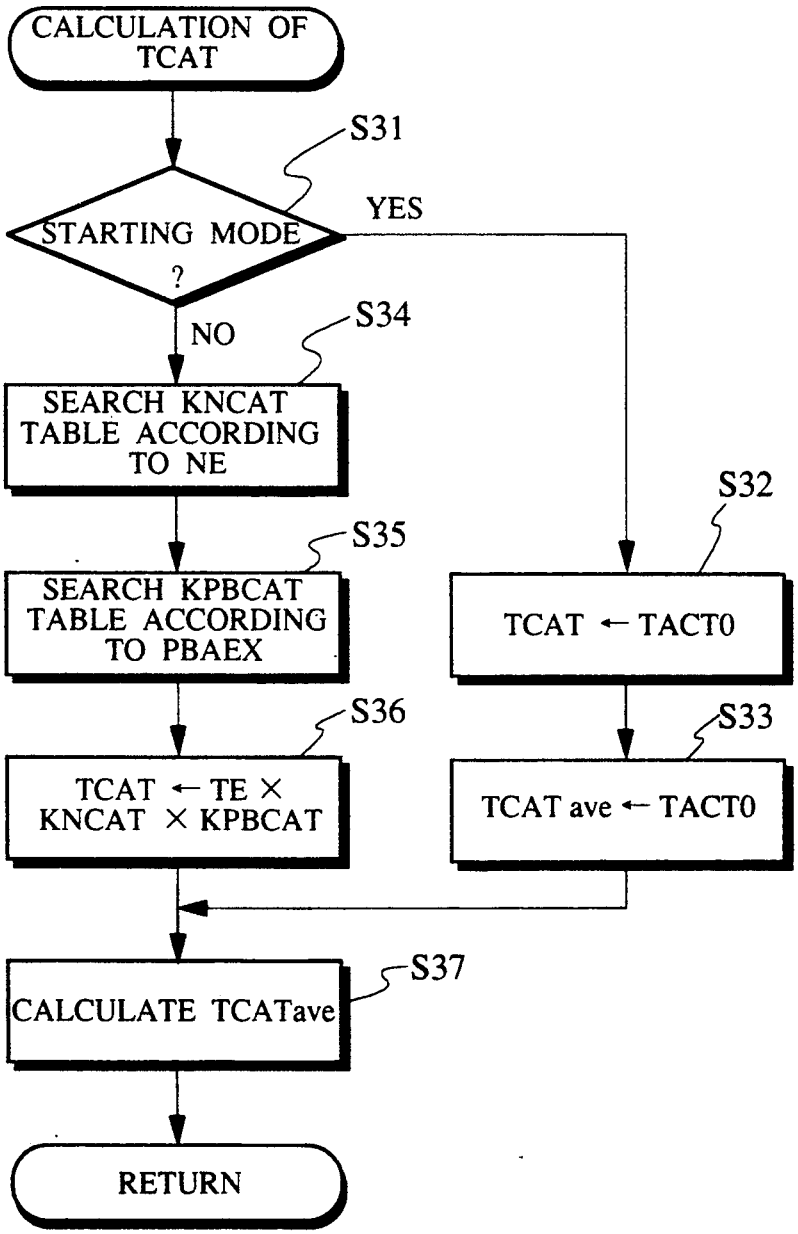
FIG. 5 is a flowchart of a subroutine for calculating an estimated temperature value (TCAT) of a three-way catalyst.

In FIG. 5, at a step S31, it is determined whether or not the engine is in a starting mode. If the answer to this question is affirmative (YES), i.e. if the engine is in the starting mode, both the catalyst temperature TCAT and an average value TCATave thereof are set to a predetermined initial value TCATO (e.g. 400° C.) at steps S32 and S33, and then the program proceeds to a step S37.

If the answer to the question of the step S31 is negative (NO), i.e. if the engine is not in the starting mode, correction coefficients KNCAT and KPBCAT for converting the exhaust gas temperature TE detected into the catalyst temperature TCAT are calculated at steps S34 and S35, and then the catalyst temperature TCAT is obtained by multiplying the exhaust gas temperature TE by these correction coefficients at a step S36.

Figure 6A:
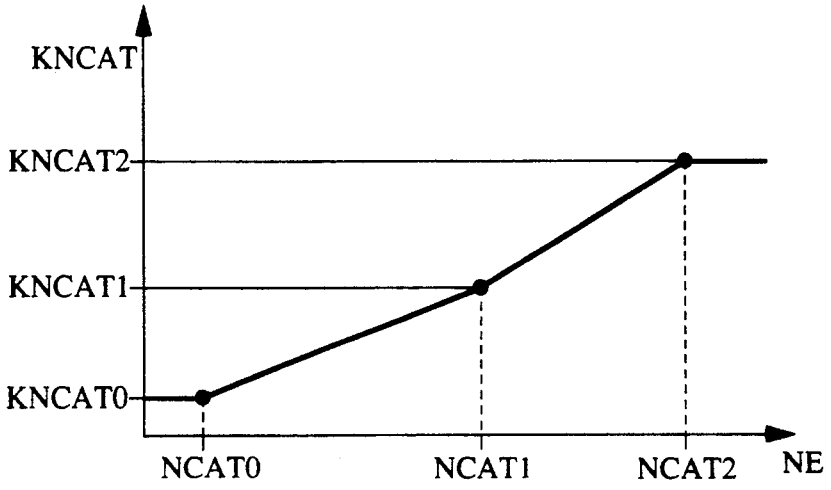
FIG. 6*a* is a diagram showing a table for calculating a coefficient (KNCAT) for correcting an exhaust gas temperature value.

KNCAT is an engine rotational speed-dependent correction coefficient set according to the engine rotational speed. As shown in FIG. 6a, a value thereof is read from a KNCAT table in which values KNCAT0 to KNCAT2 are set corresponding to predetermined values NCAT0 and NCAT2 of the engine rotational speed. The correction coefficient KNCAT assumes a larger value as the engine rotational speed NE is higher, and if NE=NCAT1 (e.g. 3,000 rpm), KNCAT=1.0.

Figure 6B:
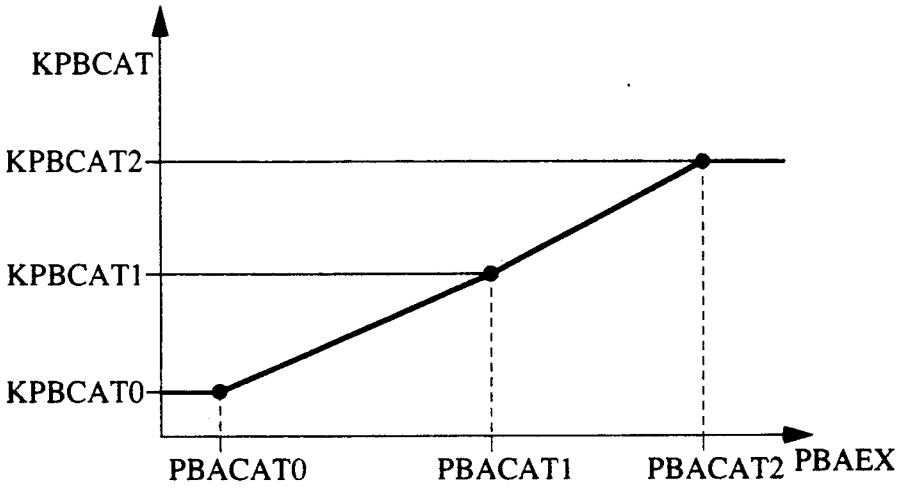
FIG. 6*b* is a diagram showing a table for calculating a coefficient (KPBCAT) for correcting an exhaust gas temperature value.

KPBCAT is an engine load-dependent correction coefficient which is set according to the corrected intake pipe absolute pressure PBAEX. As shown in FIG. 6b, a value thereof is read from a KPBCAT table in which values KPBCAT0 to KPBCAT2 are set corresponding to predetermined values PBACAT0 to PBACAT2 of the corrected intake pipe absolute pressure PBAEX. The correction coefficient KPBCAT assumes a larger value as the corrected intake pipe absolute pressure PBAEX is higher, and if PBAEX=PBACAT1 (e.g. 510 mmHg), KPBCAT=1.0.

The reason for setting the correction coefficients KNCAT and KPBCAT such that they increase as the engine rotational speed NE and the intake pipe absolute pressure PBA increase is that the rate of thermal conduction varies with the volume of exhaust gases, which causes a resulting variation in the temperature of a component part (in this case the three-way catalyst) of the engine. In estimating temperatures of the exhaust pipe, the pistons in the cylinders, and the exhaust valves, which will be described later, the exhaust gas temperature TE will be converted into the respective temperatures in a similar manner, i.e. by correcting the exhaust gas temperature TE according to the volume of exhaust gases which is determined by the engine rotational speed NE and the engine load.

Figure 6C:
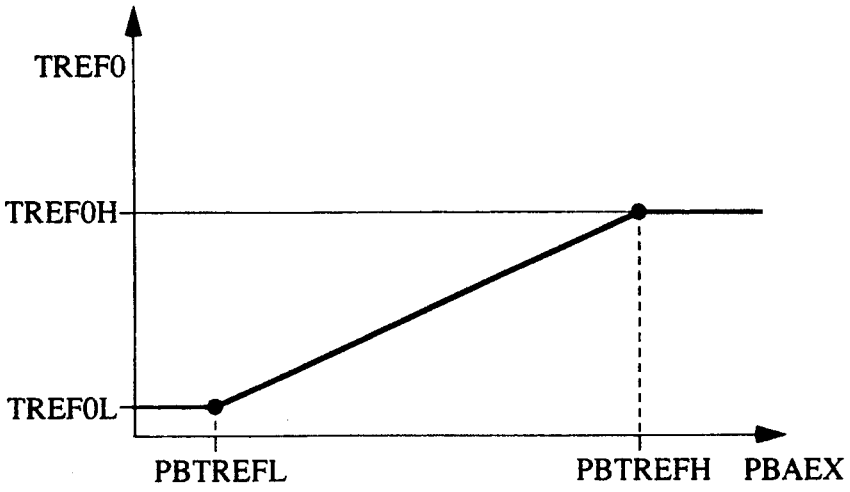
FIG. 6*c* is a diagram showing a table for calculating an averaging coefficient (TREFO)

At a step S37, an average value TCATave of the catalyst temperature is calculated by the use of the following equation (2):

$$TCATave(n) = TCAT(n) \times TREFO/65536 + TCATave(n-1) \times (65536 - TREFO)/65536 \quad (2)$$

wherein (n) and (n−1) indicate that the values are obtained in the present loop and the last loop, respectively. TREFO is an averaging coefficient which determines the rate of contribution of a present value TCAT(n) of the catalyst temperature to a present value TCATave(n) of the average value. As TREFO increases, TCAT(n) contributes to TCATave(n) at a larger rate, so that the averaging speed increases. In this connection, in the present embodiment, the averaging coefficient TREFO is read from a TREFO table, as shown in FIG. 6c, in which values thereof are set according to the corrected intake pipe absolute pressure PBAEX.

In the TREFO table, predetermined values TREFOL and TREFOH (e.g. 87, 1190) are set corresponding to predetermined values PBTREFL and PBTREFH (e.g. 150 mmHg, 480 mmHg) of the corrected intake pipe absolute pressure. The averaging value TREFO increases as the engine load is higher. This takes into consideration the fact that as the engine load is lower, the volume of exhaust gases (the amount of exhaust gases emitted per unit time period) is smaller, which results in a smaller rate of change in the temperature of a component part. By thus setting the averaging coefficient TREFO, it is possible to obtain a proper average value TCATave corresponding to the engine load.

Further, an amount of rise in the temperature of a component part of the engine per unit time period is dependent not only on the engine rotational speed and the engine load but also on the thermal capacity of the component part, each component part of the engine having a thermal capacity peculiar thereto. Therefore, the averaging coefficient TREF is set for each component part, separately. In estimating the temperatures of the exhaust pipe, the pistons in the cylinders, and the exhaust valves, which will be described later, the averaging coefficient TREF is set for each of the component parts in a similar manner according to an amount of rise in the temperature of the component part of the engine per unit time period.

Figure 7:
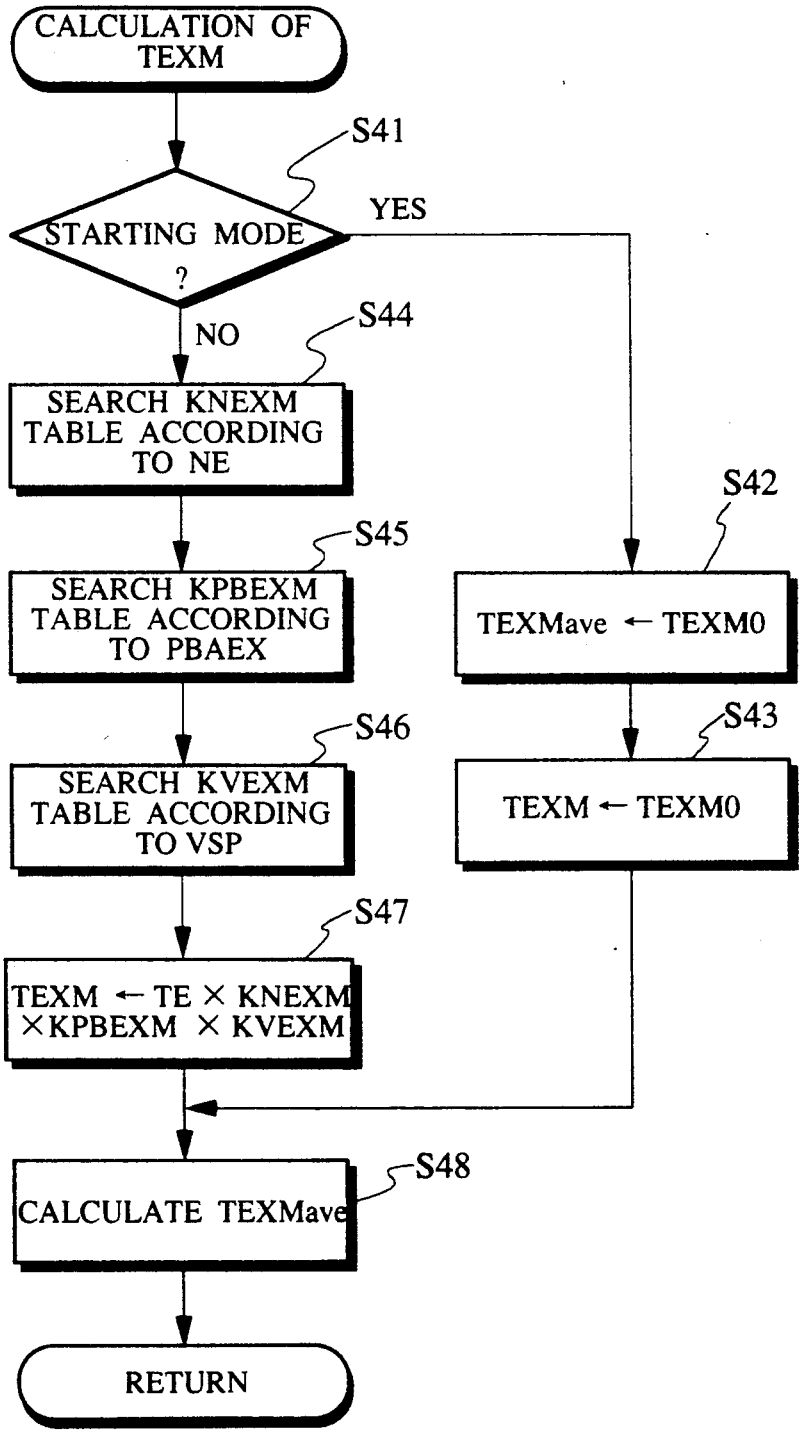
FIG. 7 is a flowchart of a subroutine for calculating an estimated temperature value (TEXM) of an exhaust pipe.

Referring again to FIG. 2, at a step S4, an estimated temperature value (herinafter simply referred to as the "exhaust pipe temperature") TEXM of the exhaust pipe is calculated by a subroutine shown in FIG. 7.

Similarly to the program of FIG. 5, if the engine is in the starting mode (the answer to the question of the step S41 is affirmative (YES)), both the exhaust pipe temperature TEXM and an average value TEXMave thereof are set to a predetermined initial value TEXMO (e.g. 400° C.) at steps S42 and S43. On the other hand, if the engine is not in the starting mode (the answer to the question of the step S41 is negative (NO)), correction coefficients KNEXM, KPBEXM, and KVEXM for converting the exhaust gas temperature TE detected into the exhaust pipe temperature TEXM are calculated at steps S44 to S46, and then the exhaust pipe temperature TEXM is obtained by multiplying the exhaust gas temperature RE by these coefficients at a step S47.

Figure 8A:
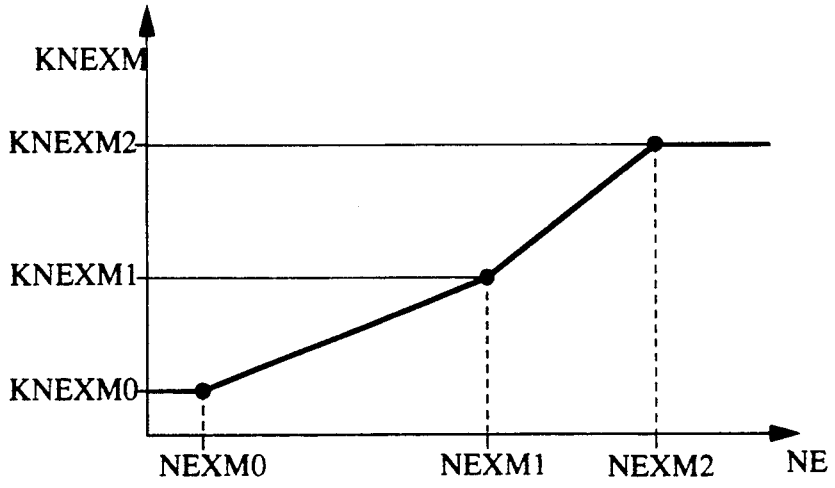
FIG. 8*a* is a diagram showing a table for calculating a coefficient (KNEXM) for correcting an exhaust gas temperature value.
Figure 8B:
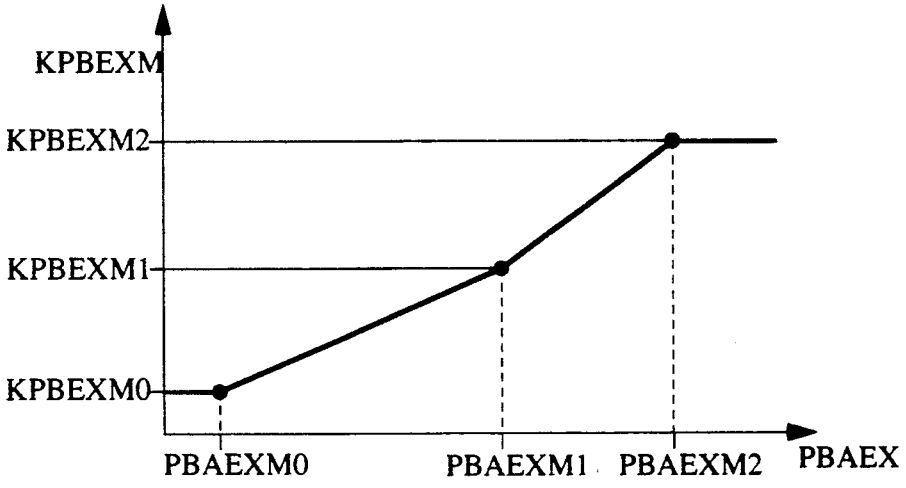
FIG. 8*b* is a diagram showing a table for calculating a coefficient (KPBEXM) for correcting an exhaust gas temperature value.

KNEXM and KPBEXM are engine rotational speed-dependent and engine load-dependent correction coefficients for obtaining the exhaust pipe temperature which correspond to the engine rotational speed-dependent correction coefficient KNCAT and the load-dependent correction coefficient KPBCAT. Values thereof are read from a KNEXM table shown in FIG. 8*a* and a KPBEXM table shown in FIG. 8*b*. In the KNEXM table, similarly to the aforementioned KNCAT table, values KNEXM0 to KNEXM2 are set corresponding to predetermined values NEXM0 to NEXM2 of the engine rotational speed, and if NE=NEXM1 (e.g. 3,500 rpm), KNEXM1=1.0. In the KPBEXM table, similarly to the KPBCAT table, values KPBEXM0 to KPBEXM2 are set corresponding to predetermined values PBAEXM0 to PBAEXM2 of the corrected exhaust pipe absolute pressure PBAEX, and if PBAEX=PBAEXM1 (e.g. 510 mmHg), KPBEXM1=1.0.

Figure 8C:
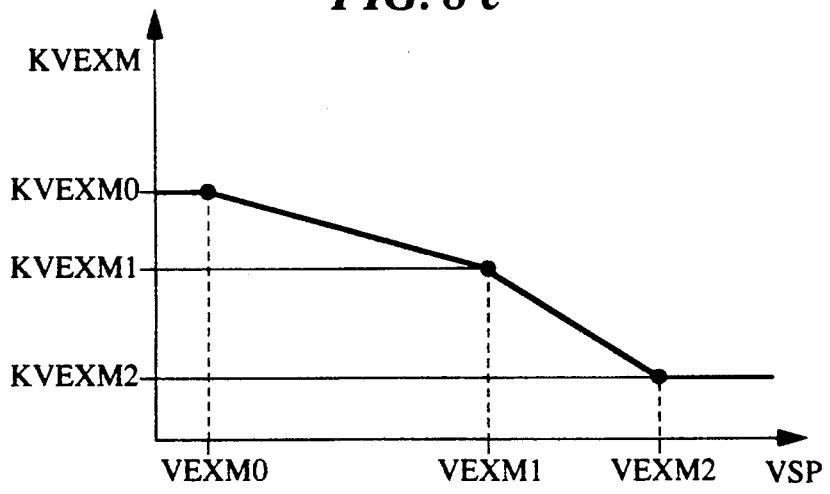
FIG. 8*c* is a diagram showing a table for calculating a coefficient (KVEXM) for correcting an exhaust gas temperature value.

KVEXM is a vehicle speed-dependent correction coefficient which is set according to the vehicle speed VSP. As shown in FIG. 8*c*, values KVEXM0 to KVEXM2 are set corresponding to predetermined values VEXM0 to VEXM2 of the vehicle speed. The coefficient KVEXM decreases as the vehicle speed VSP is lower, and if VSP=VEXM1 (e.g. 120 km/h), KVEXM=1.0. This is to lower the estimated temperature value of the exhaust pipe when the vehicle speed VSP is higher, since the exhaust pipe of the engine is more cooled as the vehicle travels at a higher speed.

At a step S48, an average value TEXave of the exhaust pipe temperature is calculated by the use of the following equation (3):

$$TEXMave(n) = TEXM(n) \times TREF1/65536 + TEXMave(n-1) \times (65536 - TREF1)/65536 \quad (3)$$

The equation (3) is similar to the equation (2), and where the averaging coefficient TREF1 is set to a fixed value, e.g. 20.

Referring again to FIG. 2, at a step S5, an estimated temperature value (hereinafter simply referred to as the "piston temperature") TPIS of the pistons in the cylinders is calculated by a subroutine shown in FIG. 9.

Figure 9:
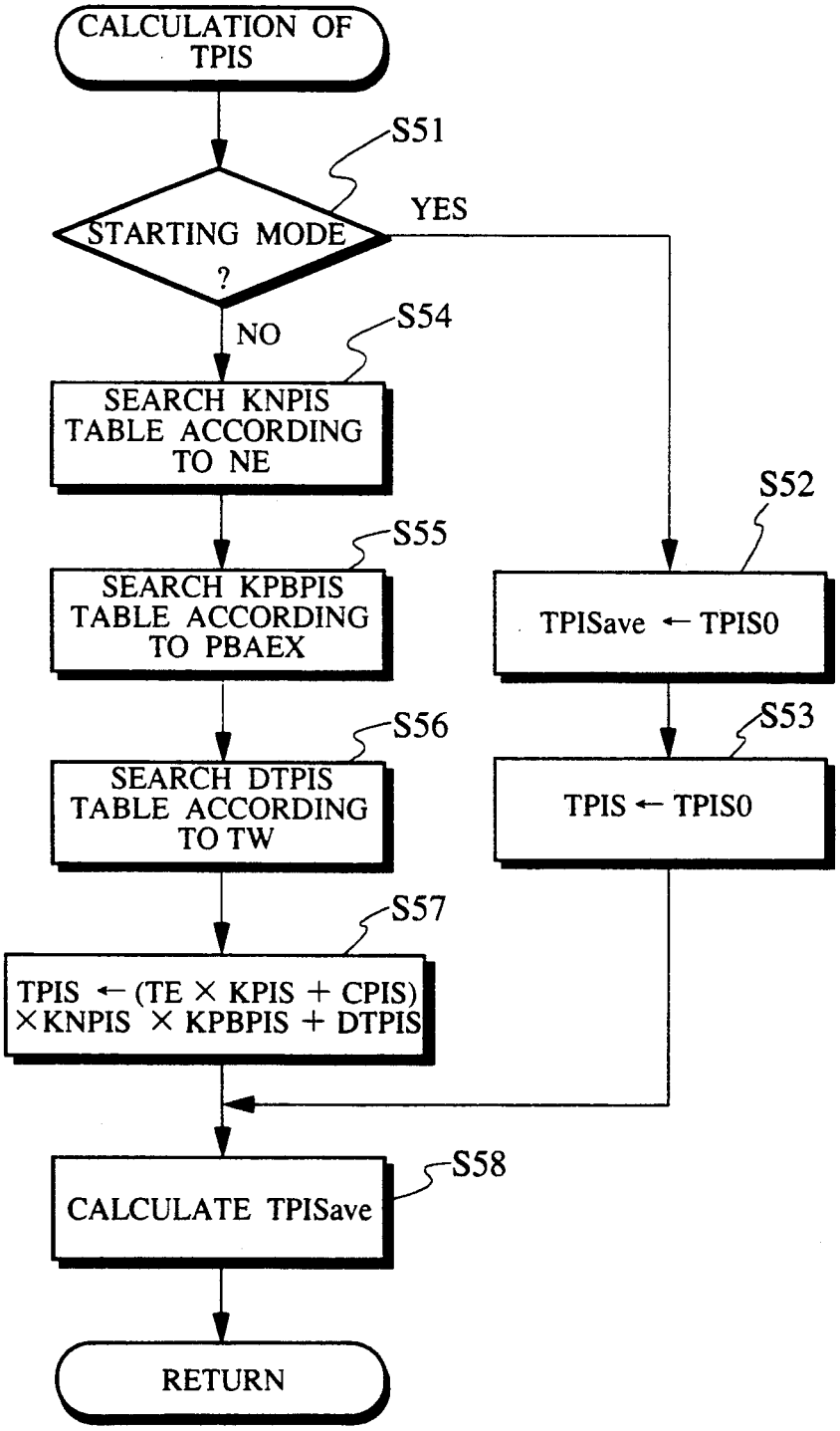
FIG. 9 is a flowchart of a subroutine for calculating an estimated temperature value (TPIS) of pistons.

In the program of FIG. 9, the piston temperature TPIS and an average value TPISave thereof are calculated in a manner similar to those of the programs described with reference to FIGS. 5 and 7. More specifically, if the engine is in the starting mode (the answer to the question of a step S51 is affirmative (YES)), both the piston temperature TPIS and the average value TPISave thereof are set to their predetermined initial value TPISO (e.g. 80° C.) at steps S52 and S53. On the other hand, if the engine is not in the starting mode (the answer to the question of the step S51 is negative (NO)), correction coefficients KNPIS and KPBPIS and a correction variable DTPIS for converting the exhaust gas temperature TE detected into the piston temperature TPIS are calculated at steps S54 to S56, and the piston temperature TPIS is obtained at a step S57 by applying these correction coefficient and variable to the following equation (4):

$$TPIS = (TE \times KPIS + CPIS) \times KNPIS \times KPBPIS + DTPIS \quad (4)$$

where KPIS is a converting coefficient which is set e.g. to approx. 0.125, and CPIS is a converting variable which is set e.g. to approx. 35° C.

Figure 10A:
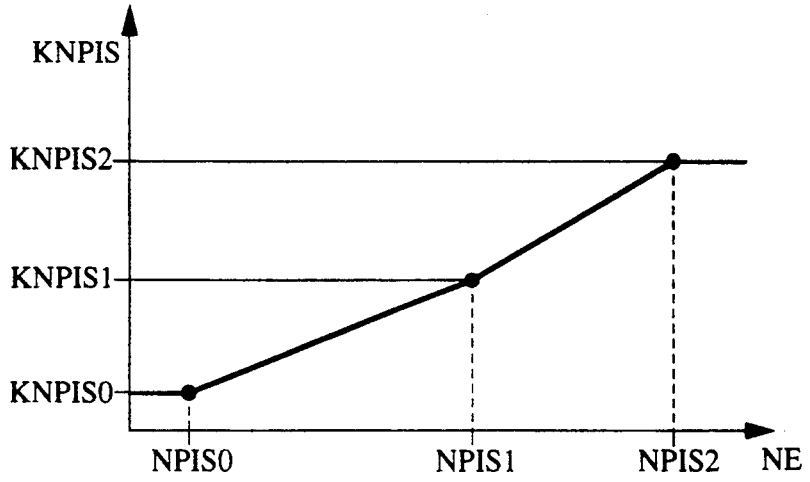
FIG. 10*a* is a diagram showing a table for calculating a coefficient (KNPIS) for correcting an exhaust gas temperature value.
Figure 10B:
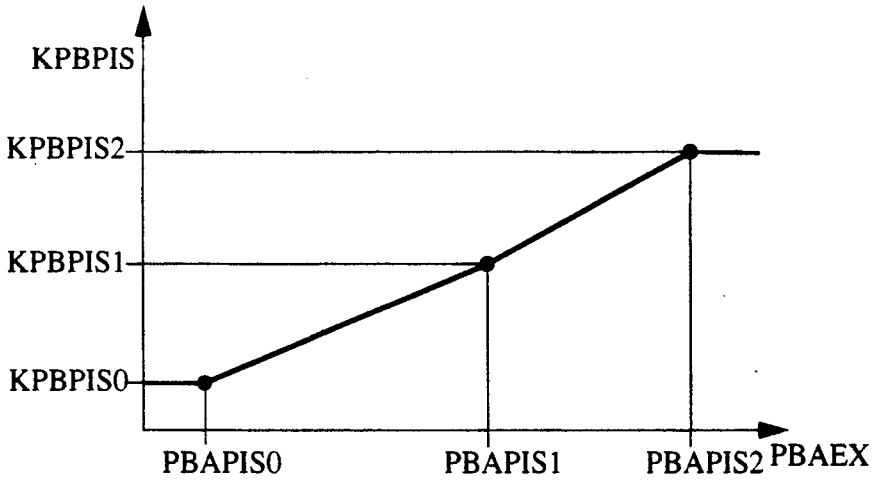
FIG. 10*b* is a diagram showing a table for calculating a coefficient (KPBPIS) for correcting an exhaust gas temperature value.

KNPIS and KPBPIS are engine rotational speed-dependent and engine load-dependent correction coefficients for obtaining the piston temperature, respectively. Values thereof are read from a KNPIS table shown in FIG. 10*a* and a KPBPIS table shown in FIG. 10*b*. In the KNIPS table, similarly to the KNCAT table, values KNPIS0 to KNPIS2 are set corresponding to predetermined values NPIS0 to NPIS 2 of the engine rotational speed, and if NE=NPIS1 (e.g. 3,500 rpm), KNPIS1=1.0. In the KPBPIS table, similarly to the KPBCAT table, values KPBPIS0 to KPBPIS2 are set corresponding to predetermined values PBAPIS0 to PBAPIS2 of the corrected intake pipe absolute pressure, and if PBAEX=PBAPIS1 (e.g. 510 mmHg), KPBPIS=1.0.

Figure 10C:
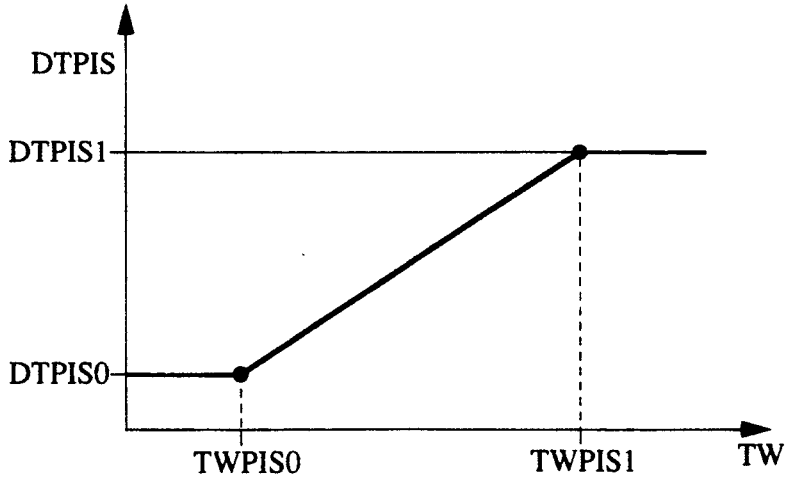
FIG. 10*c* is a diagram showing a table for calculating a variable (DTPIS) for correcting an exhaust gas temperature value.

DTPIS is a correction variable set according to the engine coolant temperature TW, and a value thereof is read from a DTPIS table shown in FIG. 10*c* in which values DTPIS0 and DTPIS1 (e.g. 30° C. and 115° C., respectively) are set corresponding to predetermined values TWPIS0 and TWPIS1 (e.g. 50° C. and 120° C., respectively) of the engine coolant temperature.

At a step S58, an average value TPISave of the piston temperature is calculated by the use of the following equation (5), followed by terminating the present subroutine:

$$TPISave(n) = TPIS(n) \times TREF2/65536 + TPISave(n-1) \times (65536 - TREF2)/65536 \quad (5)$$

The equation (5) is similar to the equation (3), and where the averaging coefficient TREF2 is set to a fixed value, e.g. approx. 8.

Referring again to FIG. 2, at a step S6, an estimated temperature (hereinafter simply referred to as the "exhaust valve temperature") TEXV of the exhaust valves is calculated by a subroutine shown in FIG. 11.

Figure 11:
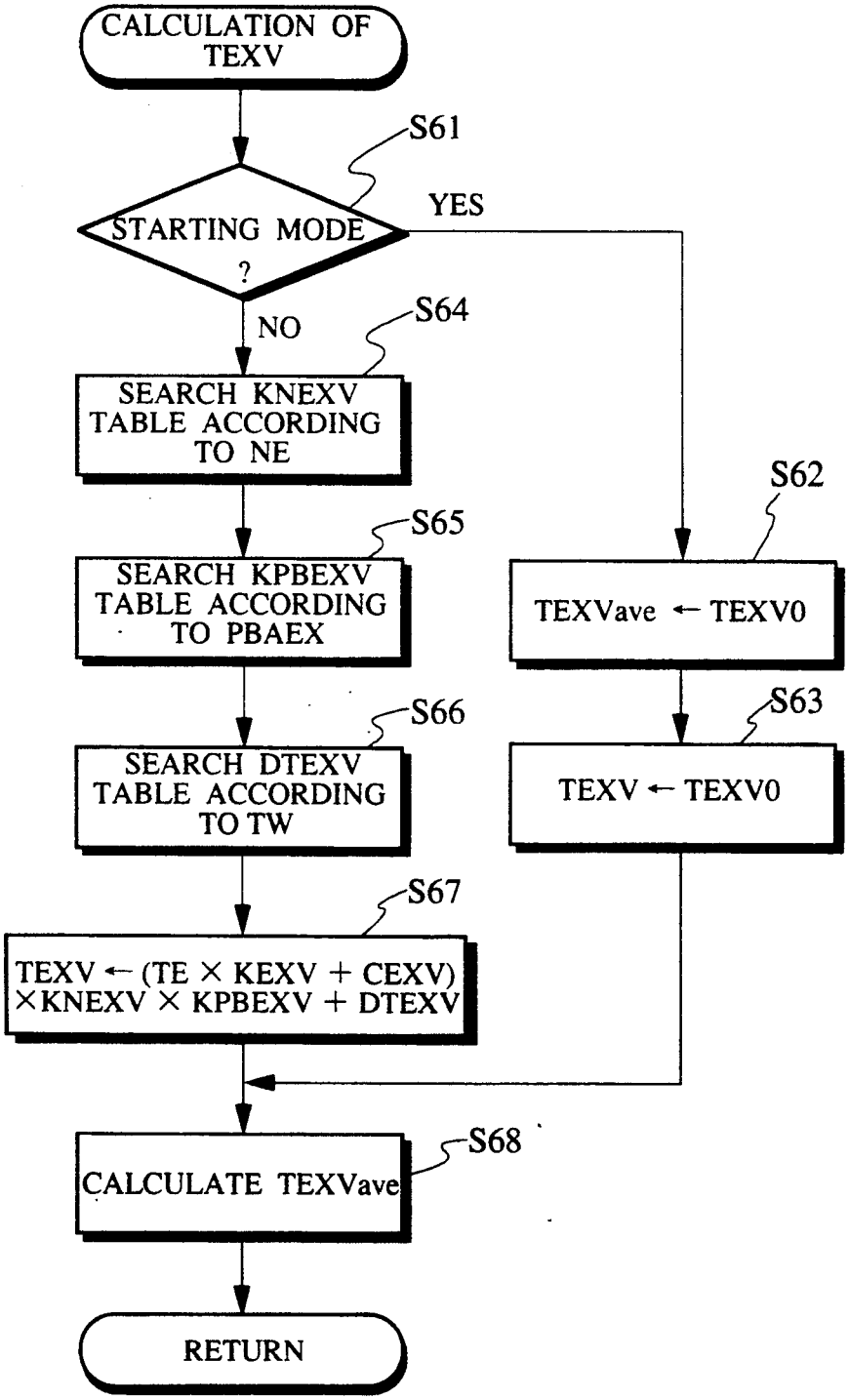
FIG. 11 is a flowchart of a subroutine for calculating an estimated temperature value (TEXV) of exhaust valves.

In the program of FIG. 11, the exhaust valve temperature TEXV and an average value TEXVave thereof are calculated in a manner similar to that of the program described with reference to FIG. 9. More specifically, if the engine is in the starting mode (the answer to the question of a step S61 is affirmative (YES)), both the exhaust valve temperature TEXV and the average value TEXVave thereof are set to a predetermined initial value TEXVO (e.g. 200° C.) at steps S62 and S63. On the other hand, if the engine is not in the starting mode (the answer to the question of the step S61 is negative (NO)), correction coefficients KNEXV and KPBEXV and a correction variable DTEXV for converting the exhaust gas temperature TE detected into the exhaust valve temperature TEXV are calculated at steps S64 to S66, and the exhaust valve temperature TEXV is obtained at a step S67 by applying these correction coefficients and variable to the following equation (6):

$$TEXV = (TE \times KEXV + CEXV) \times KNEXV \times KPBEXV + DTEXV \quad (6)$$

where KEXV is a converting coefficient which is set e.g. to approx. 0.185, and CEXV is a converting variable which is set e.g. to approx. 80° C.

Figure 12A:
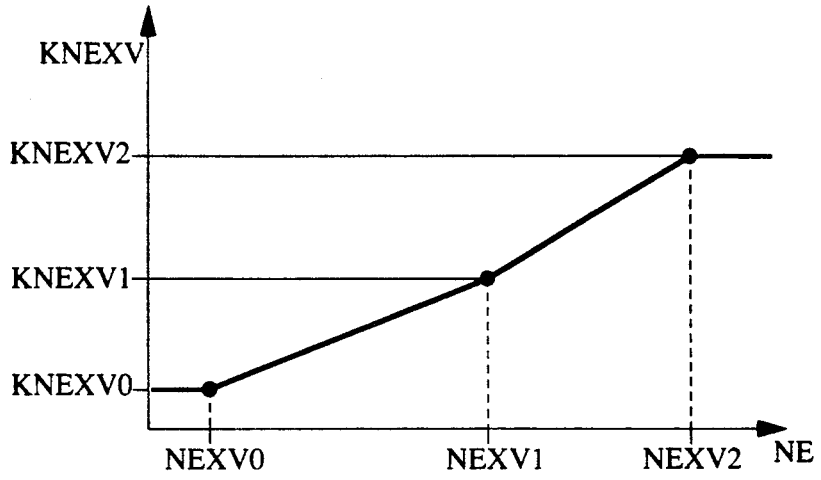
FIG. 12*a* is a diagram showing a table for calculating a coefficient (KNEXV) for correcting an exhaust gas temperature value.
Figure 12B:
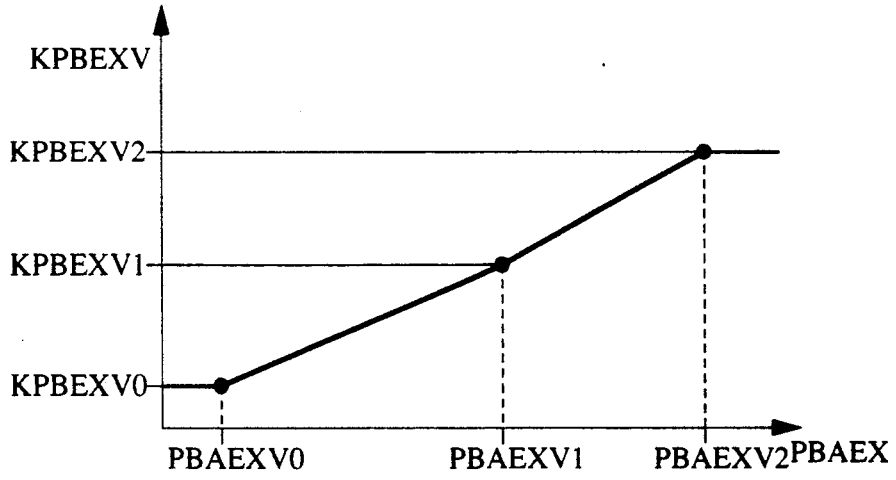
FIG. 12*b* is a diagram showing a table for calculating a coefficient (KPBEXV) for correcting an exhaust gas temperature value.

KNEXV and KPBEXV are engine rotational speed-dependent and engine load-dependent correction coefficients for obtaining the exhaust valve temperature, respectively. Values thereof are read from a KNEXV table shown in FIG. 12*a* and a KPBEXV table shown in FIG. 12*b*. In the KNEXV table, similarly to the KNCAT table, values KNEXV0 to KNEXV2 are set corresponding to predetermined values NEXV0 to NEXV2 of the engine rotational speed, and if NE=NEXV1 (e.g. 3,500 rpm), KNEXV1=1.0. In the KPBEXV table, similarly to the KPBEXV table, values KPBEXV0 to KPBEXV2 are set corresponding to predetermined values PBAEXV0 to PBAEXV2 of the corrected intake pipe absolute pressure, and if PBAEX=PBAEXV1 (e.g. 510 mmHg), KPBEXV=1.0.

Figure 12C:
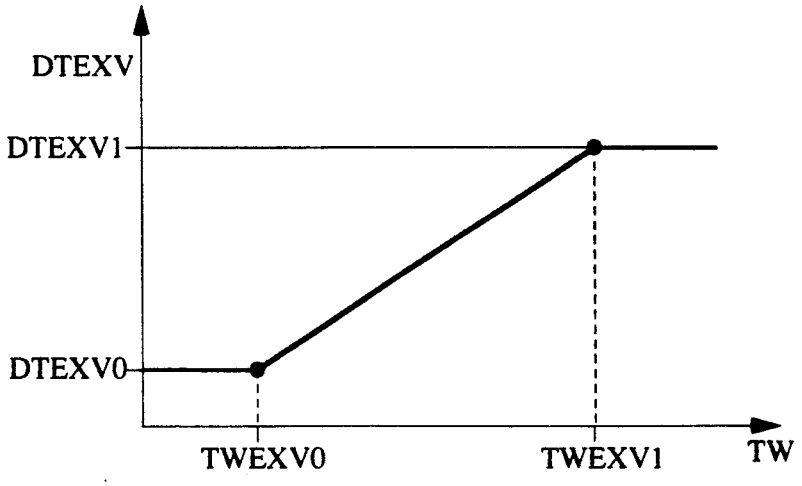
FIG. 12*c* is a diagram showing a table for calculating a variable (DTEXV) for correcting an exhaust gas temperature value.

DTEXV is a correction variable set according to the engine coolant temperature TW, and a value thereof is read from a DTEXV table shown in FIG. 12*c* in which values DTEXV0 and DTEXV1 (e.g. 10° C. and 140° C., respectively) are set corresponding to predetermined values TWEXV0 and TWEXV1 (e.g. 85° C. and 110° C., respectively) of the engine coolant temperature.

At a step S68, an average value TEXVave of the exhaust valve temperature is calculated by the use of the following equation (7), followed by terminating the present subroutine:

$$TEXVave(n) = TEXV(n) \times TREF3/65536 + TEXVave(n-1) \times (65536 - TREF3)/65536 \quad (7)$$

The equation (7) is similar to the equation (3), and where the averaging coefficient TREF3 is set to a fixed value, e.g. approx. 20.

According to the steps S3 to S6 described above, the exhaust gas temperature TE detected is corrected by the engine rotational speed-dependent correction coefficients (KNCAT, KNEXM, KNPIS, KNEXV), the engine load-dependent correction coefficients (KPBACAT, KPBEXM, KPBPIS, KPBEXM), etc to thereby obtain the estimated temperature values (TCAT, TEXM, TPIS, TEXM) of the component parts (three-way catalyst, exhaust pipe, pistons, exhaust valves) of the engine. This enables to accurately estimate the temperatures of the component parts which reflect the influence of the volume of exhaust gases.

Further, it is determined, based on these estimated temperature values, whether or not the supply air-fuel ratio should be enriched, as will be described later, which enables to prevent unnecessary enriching of the supply air-fuel ratio, and reduce fuel consumption and emission of CO.

Figure 13:
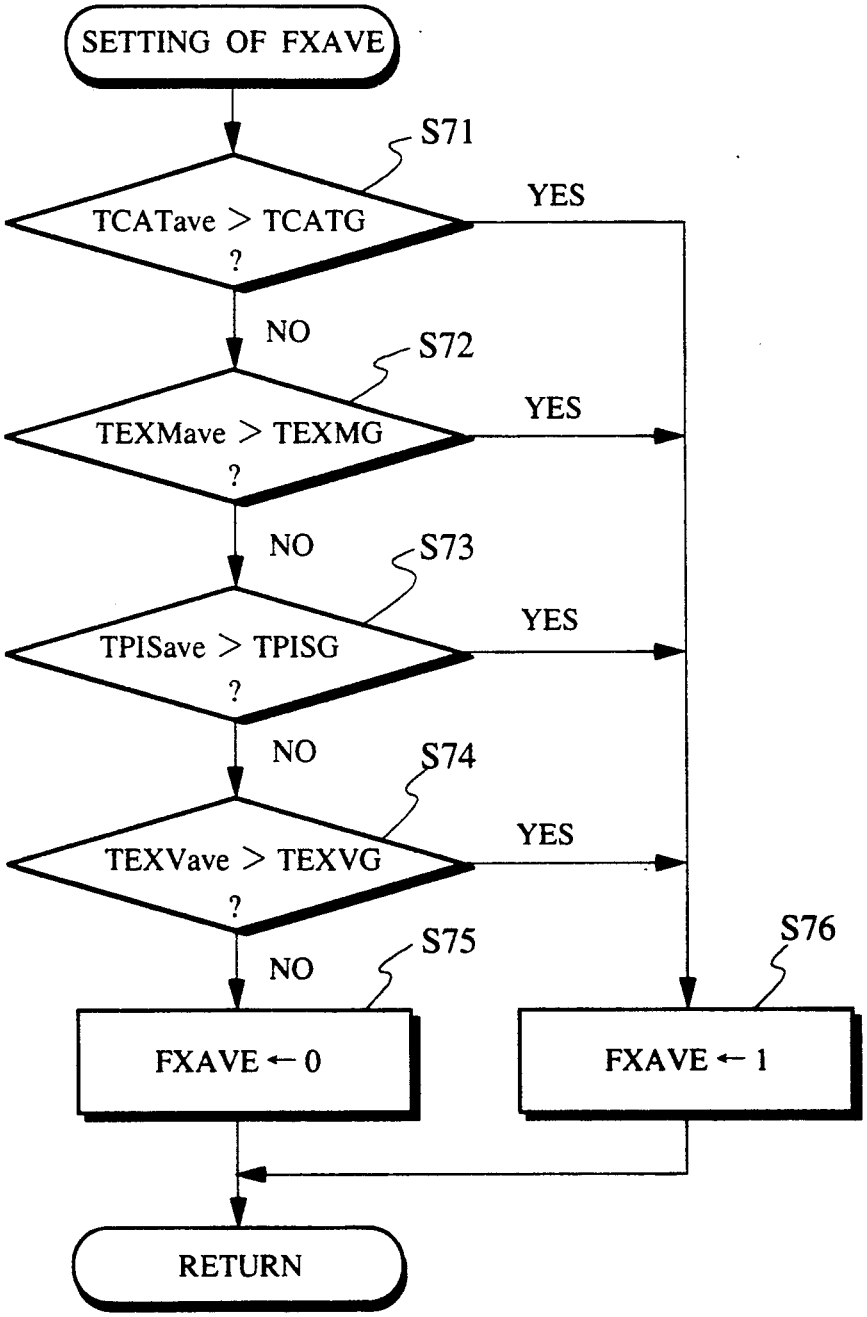
FIG. 13 is a flowchart of a subroutine for setting a high temperature flag (FXAVE)

Referring again to FIG. 2, at a step S7, a high temperature flag FXAVE for indicating that the supply air-fuel ratio should be enriched is set according to a subroutine shown in FIG. 13.

At steps S71 to S74 in FIG. 13, it is determined whether or not the average value TCATave of the catalyst temperature calculated as above is higher than a predetermined value TCATG (e.g. 920° C.), whether or not the average value TEXMave of the exhaust pipe temperature is higher than a predetermined value TEXMG (e.g. 950° C.), whether or not the average value TPISave of the piston temperature is higher than a predetermined value TPISG (e.g. 300° C.), and whether or not the average value TEXVave of the exhaust valve temperature is higher than a predetermined value TEXVG (e.g. 350° C.), respectively. If any of the answers to the questions of the steps S71 to S74 is affirmative (YES), the high temperature flag FXAVE indicative of a high temperature state of the component part of the engine is set to a value of 1 at a step S76, whereas if all the answers are negative (NO), the flag FXAVE is set to a value of 0 at a step S75, followed by terminating the present program.

Figure 15:
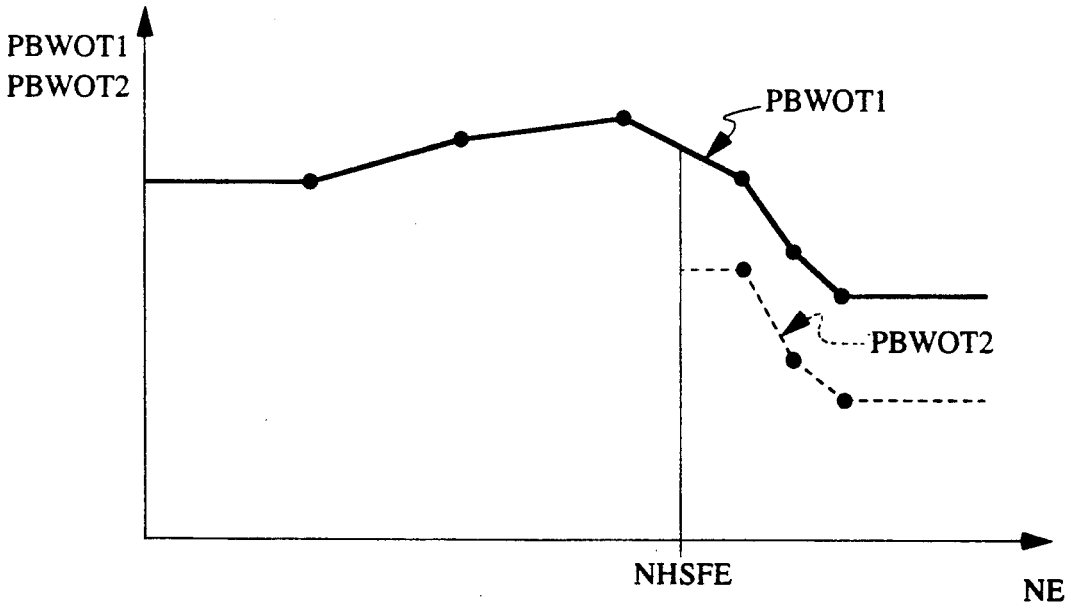
FIG. 15 is a diagram showing a table for calculating reference values (PBWOT1, PBWOT2) for determining whether the engine is in a high load operating condition.

Referring again to FIG. 2, at a step S8, it is determined whether or not the high temperature flag FXAVE is equal to 1. If the answer to this question is negative (NO), i.e. if FXAVE=0, a counter CHSFE for measuring a time period elapsed after the high temperature flag FXAVE was changed from 0 to 1 is set a predetermined value CHSFE0 (e.g. 250). Then, it is determined at a step S10 whether or not a second high load flag FWOT2, which is set to a value of 1 when the engine is in a high load operating condition in which the intake pipe absolute pressure PBA assumes a value higher than a second reference value PBWOT2, is equal to 1. The second reference value PBWOT2 is set, as shown by the broken line in FIG. 15, according to the engine rotational speed NE. In the figure, PBWOT1 is a first reference value which is also set according to the engine rotational speed NE. In this connection, when the engine rotational speed NE is lower than a predetermined value NHSFE shown therein, PBWOT2=P-

BWOT1. If the intake pipe absolute pressure PBA is higher than the first reference value, a first high load flag FWOT1 is set to a value of 1. The first and second high load flags FWOT1 and FWOT2 are used in a program shown in FIGS. 14*a* and 14*b*.

Referring again to FIG. 2, if the answer to the step S10 is negative (NO), i.e. if FWOT2=0, which means that the engine is not in the high load operating condition. a timer tMWOTX is set to a predetermined time period TMWOTX0 (e.g. 90 seconds) and started at a step S11, and second and first enriching flags FHSFE2, FHSFE1 are set to a value of 0 at steps S12, S13, respectively, followed by terminating the present program.

If the answer to the question of the step S10 is affirmative (YES), i.e. if FWOT2=1, which means that the engine is in the high load operating condition, it is determined at a step S14 whether or not the count value of the timer tMWOTX is equal to 0. If the answer to this question is negative (NO), i.e. if the predetermined time period TMWOTX0 has not elapsed after the second high load flag FWOT2 was changed from 0 to 1, the present program is immediately terminated. On the other hand, if the answer to the question of the step S14 is affirmative (YES), i.e. the predetermined time period TMWOTX0 has elapsed, it is determined at a step S20 whether or not the first enriching flag FHSFE1 is equal to 1. If the answer to this question is affirmative (YES), the present program is immediately terminated, whereas if the answer is negative (NO), the first enriching flag FHSFE1 is set to a value of 1 at a step S21, followed by terminating the present program.

If the answer to the question of the step S8 is affirmative (YES), i.e if FXAVE=1, the timer tMW0TX is set to the predetermined time period TMWOTX0 and started at a step S15, and it is determined at a step S16 whether or not the second enriching flag FHSFE2 is equal to 1. If the answer to this question is affirmative (YES), the present program is immediately terminated, whereas if the answer is negative (NO), i.e. if FHSFE2=0, it is determined at a step S17 whether or not the count value of the counter CHSFE set at the step S9 is equal to 0. If the answer to this question is negative (NO), i.e. if CHSFE>0, the count value is decreased by a decrement of 1 at a step S19, followed by the program proceeding to the step S20. If the answer to the question of the step S17 is affirmative (YES), i.e. if CHSFE=0, the second enriching flag FHSFE2 is set to a value of 1 at a step S18, followed by terminating the present program.

The setting of the first and second enriching flags FHSFE1, FHSFE2 according to the above steps S8 to S21 can be summarized as follows:

(i) If FXAVE=0 and FWOT2=0, FHSFE1 and FHSFE2=0.

(ii) If FXAVE=0, and the predetermined time period TMWOTX0 has elapsed after the second high load flag was changed from 0 to 1, the first enriching flag FHSFE1 alone is set to 1.

(iii) If FXAVE is changed from 0 to 1, the first enriching flag FHSFE1 is immediately set to 1 (in the case where it has already been set to 1, it is held thereat), and when a time period corresponding to the predetermined count value CHSFE0 has elapsed, the second enriching flag FHSFE2 is set to 1.

Figure 14A:
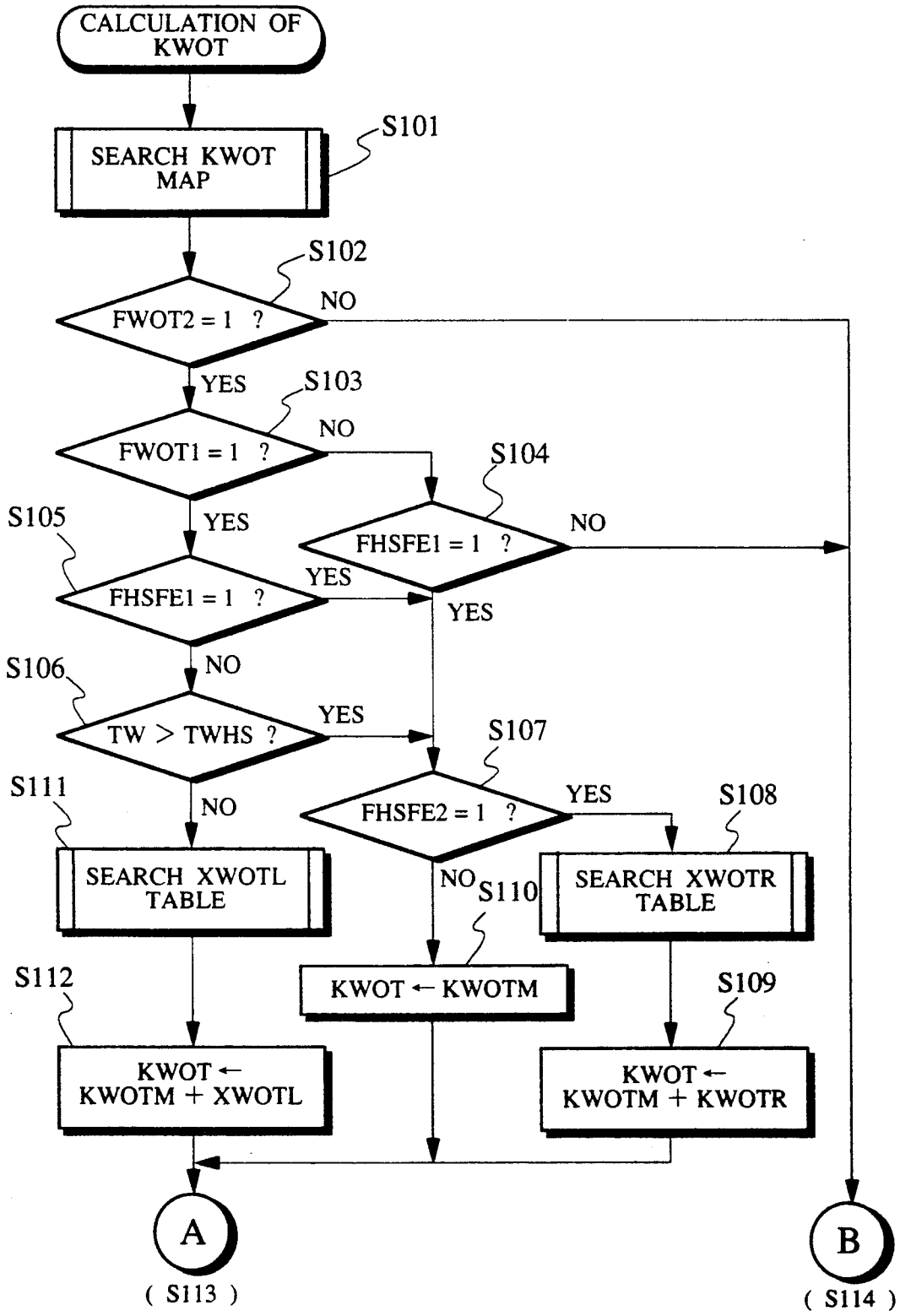
FIGS. 14*a* and 14*b* are a flowchart of a program for calculating a high load enriching coefficient (KWOT)
Figure 14B:
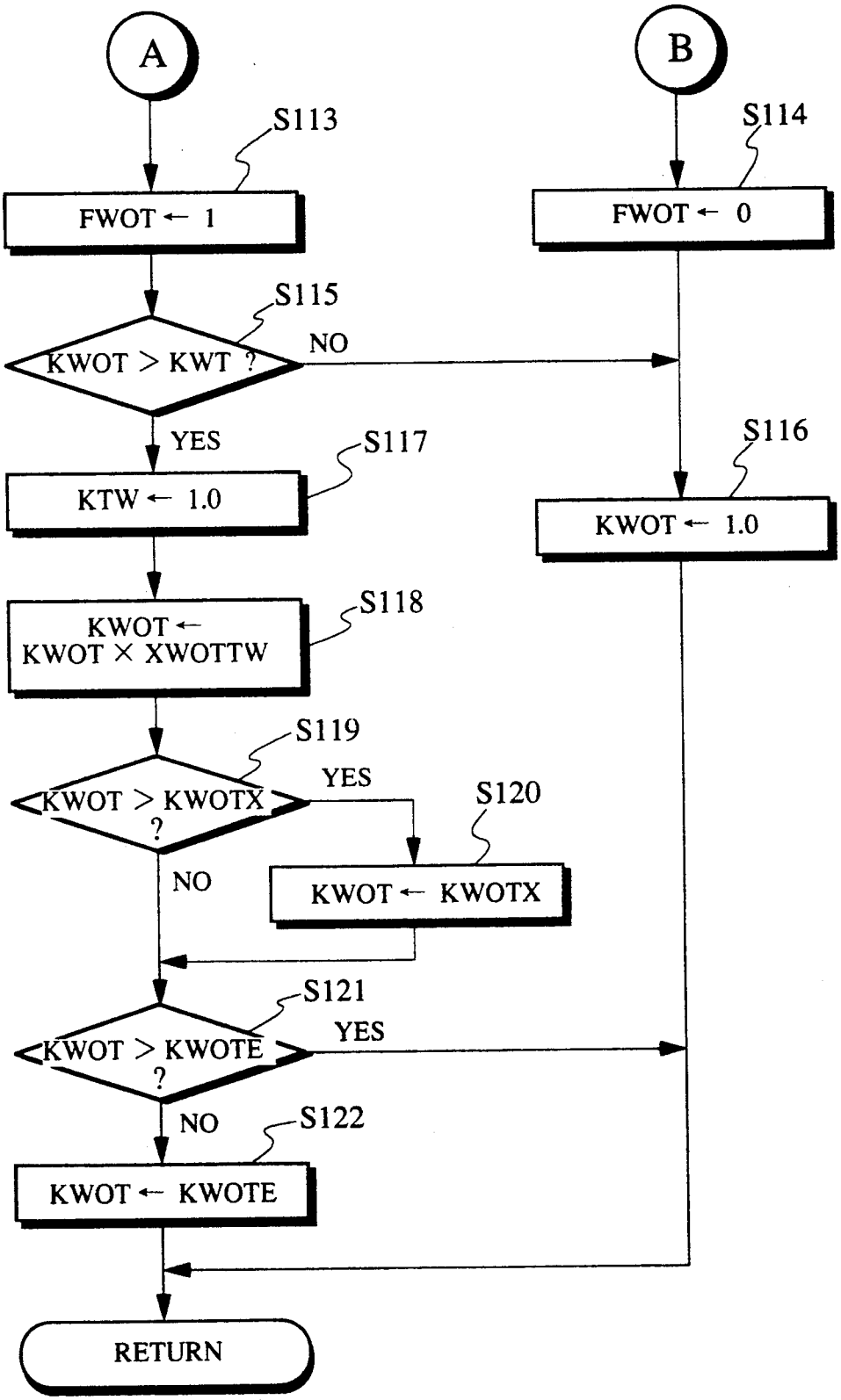

FIGS. 14*a* and 14*b* show a program for calculating a high load enriching coefficient KWOT applied to the aforementioned equation (1), for enriching the supply air-fuel ratio when the engine is in a high load condition. This program is executed whenever a TDC signal pulse is generated, and in synchronism therewith.

At a step S101, a KWOT map in which values of the high load enriching coefficient KWOT are set according to the engine rotational speed NE and the intake pipe absolute pressure PBA is searched to calculate a value of the high load enriching coefficient KWOT (this value retrieved from the map is designated as KWOTM). Then, it is determined at a step S102 whether or not the second high load flag FWOT2 is equal to 1. If the answer to this question is negative (NO), i.e. if FWOT2=0, a third high load flag FWOT is set to a value of 0 at a step S114, and the high load enriching flag KWOT is set to a value of 1.0 (correction value) at a step S116 in FIG. 14*b*.

If the answer to the question of the step S102 is affirmative (YES), i.e. if FWOT2=1, it is determined at a step S103 whether or not the first high load flag FWOT1 is equal to 1. If the answer to this question is negative (NO), i.e. if FWOT1=0, it is determined at a step S104 whether or not the first enriching flag FHSFE1 is equal to 1. If the answer to this question is negative (NO), i.e. if FHSFE1=0, the program proceeds to the step S114, whereas if the answer is affirmative (YES), i.e. if FHSFE1=1, it is determined at a step S107 whether or not the second enriching flag FHSFE2 is equal to 1. If the answer to this question is negative (NO), i.e. if FHSFE2=0, the value KWOTM retrieved from the map at the step S101 is set to the high load enriching coefficient KWOT without any change at a step S110, followed by the program proceeding to the step S113.

If the answer to the question of the step S107 is affirmative (YES), i.e. if FHSFE2=1, a value of an enriching coefficient XWOTR (>1.0) is read at a step S108 from an XWOTR table in which values of the enriching coefficient XWOTR are set according to the engine rotational speed NE, and a value obtained by multiplying the value KWOTM retrieved from the map at the step S101 by the enriching coefficient XWOTR is set as the high load enriching coefficient KWOT at a step S109, followed by the program proceeding to the step S113.

If the answer to the question of the step S103 is affirmative (YES), i.e. if FWOT1=1, it is determined at a step S105 whether or not the first enriching flag FHSFE1 is equal to 1. If the answer to this question is negative (NO), it is further determined at a step S106 whether or not the engine coolant temperature TW is higher than a predetermined value TWHS (e.g. 95° C.). If either the answer to the question of the step S105 or the answer to that of the step S106 is affirmative (YES), i.e. if FHSFE1=1 or TW>TWHS, the program proceeds to the step S107.

Figure 16:
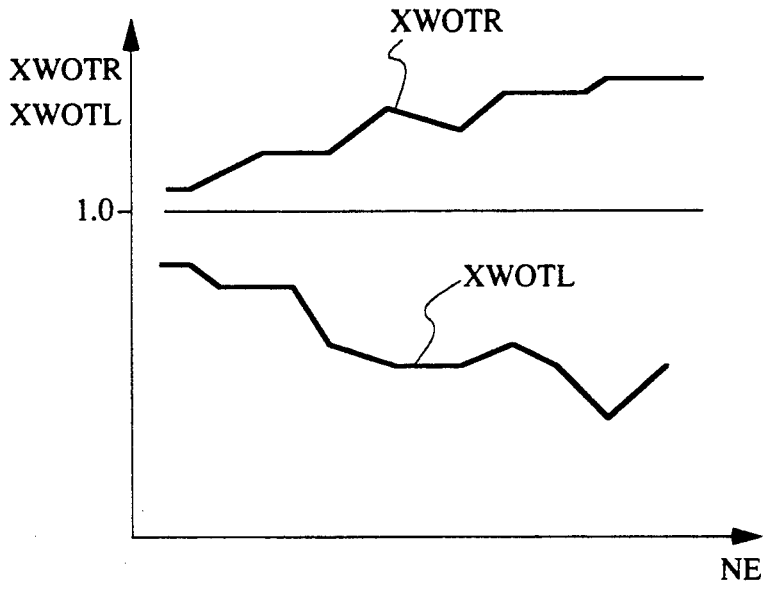
FIG. 16 is a diagram showing a table for calculating an enriching coefficient (XWOTR) and a leaning coefficient (XWOTL)

If both the answers to the questions of the steps S105 and S106 are negative (NO), i.e. if FHSFE1=0 and TW<TWHS, a value of a leaning coefficient XWOTL (<1.0) is read at a step S111 from an XWOTL table shown in FIG. 16, in which values of the leaning coefficient XWOTL are set according to the engine rotational speed NE similarly to the XWOTR table, and a value obtained by multiplying the value KWOTM retrieved from the map at the step S101 by the leaning coefficient KWOT is set as the high load enriching coefficient KWOT at a step S112, and then the program proceeds to the step S113.

According to the above steps S101 to S112, the enriching of the supply air-fuel ratio depending on the states of the first and second enriching flags FHSFE1 and FHSFE2 can be summarized as follows:

(i) If FHSFE1=1 and FHSFE2=0, the high load enriching coefficient KWOT is set to the value KWOTM retrieved from the map (at the step S110) to thereby control the air-fuel ratio to a value of A/F=11.5.

(ii) If FHSFE2=1, the high load enriching coefficient KWOT is set to the value obtained by multiplying the value KWOTM by the enriching coefficient XWOTR (at the step S109) to thereby control the air-fuel ratio to a value of A/F=10.0.

(iii) If FWOT1=FWOT2=1 and FHSFE1=0, the high load enriching coefficient KWOT is set to the value obtained by multiplying the value KWOTM by the leaning coefficient XWOTL to thereby control the air-fuel ratio to a value of A/F=13.0.

As a result, the enriching of the supply air-fuel ratio can be properly performed depending on the states of the enriching flags FHSFE1 and FHSFE2, i.e. depending on the estimated temperature values of the component parts of the engine (i.e. the state of the high temperature flag FXAVE) determined by the program shown in FIG. 2 and operating conditions of the engine (i.e. the states of the high load flags FWOT1 and FWOT2), whereby fuel consumption and emission of CO can be reduced.

At the step S113, the third high load flag FWOT is set to a value of 1, and the program proceeds to a step S115 in FIG. 14*b*, where it is determined whether or not the high load enriching coefficient KWOT is larger than the engine coolant temperature-dependent fuel increasing coefficient KTW. If the answer to this question is negative (NO), i.e. KWOT≦KTW, the program proceeds to the step S116, whereas if the answer is affirmative (YES), i.e. if KWOT>KTW, the engine coolant temperature-dependent fuel increasing coefficient KTW is set to a value of 1.0 at a step S117, and then a value obtained by multiplying the high load enriching coefficient calculated at the step S109 or S110 or S112 by an engine coolant temperature-dependent enriching coefficient XWOTTW is newly set as KWOT at a step S118.

Figure 17:
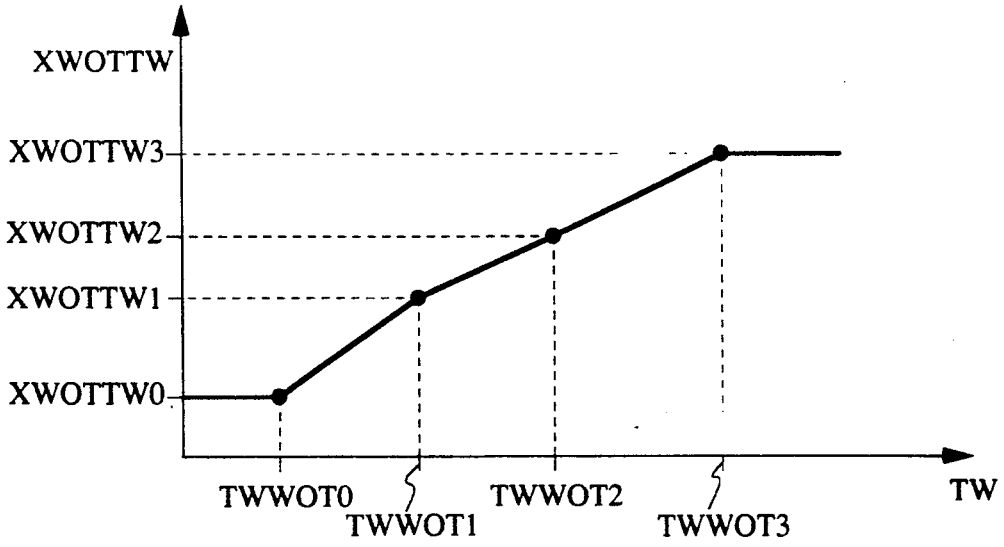
FIG. 17 is a diagram showing a table for calculating an engine coolant temperature-dependent enriching coefficient (XWOTTW).

The engine coolant temperature-dependent enriching coefficient XWOTTW is read from a table, shown in FIG. 17, in which values XWOTTW0 to XWOTTW3 (e.g. 1.0, 1.05, 1.10, and 1.15, respectively) are set corresponding to predetermined values TWWOT0 to TWWOT3 (e.g. 90° C., 100° C., 111° C., and 119° C.) of the engine coolant temperature.

At a step S119, it is determined whether or not the high load enriching coefficient KWOT calculated at the step S118 is larger than a predetermined upper limit value KWOTX (e.g. 1.38). If the answer to this question is negative (NO), the program immediately proceeds to a step S121, whereas if the answer is affirmative (YES), the high load enriching coefficient KWOT is set to the predetermined upper limit value KWOTX, and then the program proceeds to the step S121. At the step S121, it is determined whether or not the high load enriching coefficient KWOT is larger than a predetermined lower limit value KWOTE (1.31). If the answer to this question is affirmative, the program is immediately terminated, whereas if the answer is negative (NO), the high load enriching coefficient KWOT is set to the predetermined lower limit value KWOTE at at a step S122, followed by terminating the present program.

According to the steps S119 to S122, when the high load enriching coefficient assumes a value outside the range determined by the predetermined upper and lower limit values, it is set to the predetermined upper limit value KWOT or the predetermined lower limit value KWOTE.

What is claimed is:

1. An air-fuel ratio control method for an internal combustion engine including an exhaust passage, an exhaust gas ingredient concentration sensor arranged in said exhaust passage for detecting concentration of an exhaust gas ingredient, and at least one component part temperature of which is to be controlled, wherein the air-fuel ratio of an air-fuel mixture supplied to said engine is feedback-controlled to a predetermined value in response to an output from said exhaust gas ingredient concentration sensor, and when it is determined that said engine is in a predetermined high load operating condition and at the same time said at least one component part of said engine is in a predetermined high temperature state, the air-fuel ratio of said air-fuel mixture is inhibited from being feedback-controlled but enriched instead, the improvement comprising the steps of:

(1) detecting a temperature of exhaust gases emitted from said engine;

(2) detecting rotational speed of said engine;

(3) detecting load on said engine;

(4) estimating temperature of said at least one component part of said engine based on said temperature of exhaust gases, engine rotational speed, and engine load, detected at the above steps (1) to (3); and (5) determining that said at least one component part of said engine is in said predetermined high temperature state when said estimated temperature of any one of said at least one component part of said engine is higher than a corresponding predetermined value.

2. An air-fuel ratio control method according to claim 1, wherein said estimated temperature T of said at least one component part of said engine is calculated by the use of the following equation:

$$T=TE\times KNE\times KPB$$

where TE represents said detected temperature of exhaust gases, KNE represents an engine rotational speed-dependent correction coefficient set according to said detected engine rotational speed, and KPB represents an engine load-dependent correction coefficient set according to said detected engine load.

3. An air-fuel ratio control method according to claim 2, wherein said engine rotational speed-dependent correction coefficient KNE is set to a larger value as said engine rotational speed is higher, and said engine load-dependent correction coefficient KPB is set to a larger value as said engine load is higher.

4. An air-fuel ratio control method according to claim 1, 2, or 3, wherein said estimated temperature of said at least one component part of said engine is obtained by averaging a plurality of values of said estimated temperature, and the speed of said averaging is changed depending on said engine load.

5. An air-fuel ratio control method according to claim 4, wherein said engine load is intake pipe absolute pressure corrected according to intake air temperature.

6. An air-fuel ratio control method according to claim 1, wherein the air-fuel ratio of an air-fuel mixture supplied to said engine is controlled to a first value richer than a stoichiometric air-fuel ratio after it was determined that said at least one component part of said engine is in said predetermined high temperature state and before a predetermined time period elapses thereafter, and the air-fuel ratio of said air-fuel mixture is controlled to a second value richer than said first value after said predetermined time period elapses.

7. An air-fuel ratio control method according to claim 6, wherein said enriching of the air-fuel ratio of said air-fuel mixture is carried out by multiplying a basic amount of fuel supplied to said engine, which is determined according to said engine rotational speed detected and intake pipe pressure, by a predetermined enriching coefficient, said predetermined enriching coefficient being determined based on said engine rotational speed detected and said intake pipe pressure.

8. An air-fuel ratio control method according to claim 7, wherein said predetermined enriching coefficient is set to a value read from a map set according to said engine rotational speed detected and said intake pipe pressure before said predetermined time period elapses to thereby control the air-fuel ratio of said air-fuel mixture to said first value, said predetermined enriching coefficient being set to a value obtained by multiplying said value read from said map by an enriching coefficient after said predetermined time period has elapsed to thereby control the air-fuel ratio of said air-fuel mixture to said second value.

* * * * *